US010890869B2

(12) United States Patent
Miyahara et al.

(10) Patent No.: US 10,890,869 B2
(45) Date of Patent: Jan. 12, 2021

(54) FIXING MEMBER, HEAT FIXING APPARATUS, AND IMAGE FORMING APPARATUS

(71) Applicant: CANON KABUSHIKI KAISHA, Tokyo (JP)

(72) Inventors: Yasuhiro Miyahara, Tokyo (JP); Naoki Akiyama, Moriya (JP); Hiroto Sugimoto, Toride (JP); Hiroki Muramatsu, Tokyo (JP); Akeshi Asaka, Kashiwa (JP); Noriaki Kobayashi, Toride (JP); Matsutaka Maeda, Kawasaki (JP); Yuji Kitano, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/879,351

(22) Filed: May 20, 2020

(65) Prior Publication Data

US 2020/0371460 A1 Nov. 26, 2020

(30) Foreign Application Priority Data

May 23, 2019 (JP) ..... 2019-096549

(51) Int. Cl.
*G03G 15/20* (2006.01)

(52) U.S. Cl.
CPC . *G03G 15/2057* (2013.01); *G03G 2215/2016* (2013.01)

(58) Field of Classification Search
CPC ..... G03G 15/2053; G03G 15/2057; G03G 15/206; G03G 2215/2016; G03G 2215/2035
See application file for complete search history.

(56) References Cited

U.S. PATENT DOCUMENTS 9,134,663 B2 * 9/2015 Matsunaka ..... G03G 15/2057
2014/0348559 A1 * 11/2014 Miyahara ..... B32B 37/14 399/333

FOREIGN PATENT DOCUMENTS

JP 2005300591 A 10/2005
JP 2006259712 A 9/2006
JP 2007101736 A 4/2007
JP 2008165024 A 7/2008
(Continued)

*Primary Examiner* — Hoang X Ngo
(74) *Attorney, Agent, or Firm* — Canon U.S.A., Inc. IP Division

(57) ABSTRACT

An electrophotographic fixing member having an elastic layer that is high in thermal conductivity in the thickness direction, resists causing fracture or plastic deformation even by repeated compression in a high temperature state, and is low in hardness. The electrophotographic fixing member has a substrate, and an elastic layer provided on the substrate, wherein the elastic layer contains a filler containing an inorganic oxide and is provided on an outer circumference of the substrate, wherein (1) in a binarized image on a first cross-section in a thickness-circumferential direction of the elastic layer and a binarized image on a second cross-section in a thickness-axial direction of the elastic layer, $1.0 \leq (A/B) \leq 2.0$ and $0.40 \leq (A+B) \leq 0.50$ are satisfied; and (2) $50° \leq \theta_{Ave} \leq 90°$ is satisfied.

10 Claims, 11 Drawing Sheets

(56) References Cited

FOREIGN PATENT DOCUMENTS

| | | | |
|---|---|---|---|
| JP | 2013159748 | A | 8/2013 |
| JP | 2015001692 | A | 1/2015 |
| JP | 2016095475 | A | 5/2016 |

* cited by examiner

FIXING MEMBER, HEAT FIXING APPARATUS, AND IMAGE FORMING APPARATUS

BACKGROUND OF THE INVENTION

Field of the Invention

The present disclosure relates to a fixing member, a heat fixing apparatus and an image forming apparatus that are used in an electrophotographic image forming apparatus such as a copying machine and a printer.

Description of the Related Art

In a heat fixing apparatus that is used in an image forming apparatus, generally, rotating bodies, such as a pair of a heated roller and a roller, or a belt and a roller, are pressed against each other, and function as a fixing member. Then, when a recording medium that holds an image formed by an unfixed toner thereon is introduced into a pressure contact portion formed between the rotating bodies, and is heated, the toner is melted and the image is fixed on the recording medium.

As members for the heat fixing apparatus, there are a fixing member and a pressing member. The rotating body with which an unfixed toner image held on the recording medium is brought into contact is called a fixing member, and is called a fixing roller, a fixing belt or the like according to the shape. On the other hand, a rotating body that does not come in contact with the unfixed toner image and that is located on the opposite side across the recording medium is called a pressing member, and is called a pressing roller, a pressing belt or the like according to the shape.

As a fixing member, a structure is generally known in which an elastic layer that contains silicone rubber having heat resistance is arranged on a base body formed of a metal or a heat-resistant resin, and further is covered with a fluororesin, or has a thin layer thereof formed thereon via an adhesive.

The elastic layer of the fixing member has been required to have high thermal conductivity as well as its elastic function. For this purpose, in the elastic layer, an inorganic filler having high thermal conductivity is blended in rubber such as silicone rubber, as a thermally-conductive filler. However, if the amount of the thermally-conductive filler to be blended is increased so that the elastic layer has higher thermal conductivity, the elastic layer becomes hard and the elasticity of the elastic layer decreases, in some cases.

In recent years, it has been required to further improve the thermal conductivity in the thickness direction of the elastic layer of the fixing member, for the purpose of increasing a print speed, improving an image quality, and the like. For this reason, such a technology has been required of the elastic layer as to increase the thermal conductivity without excessively increasing a content of the thermally-conductive filler.

Japanese Patent Application Laid-Open No. 2005-300591 discloses a fixing member that achieves both the low hardness and the high thermal conductivity of an elastic layer with a relatively small amount of filler to be blended, by using a blend of a filler with a large particle size and a filler with a small particle size, as a thermally-conductive filler contained in an elastic layer. Japanese Patent Application Laid-Open No. 2007-101736 discloses a fixing roller that has an elastic layer of which the thermal conductivity is enhanced by orienting carbon fiber fillers in a thickness direction. Furthermore, Japanese Patent Application Laid-Open No. 2013-159748 discloses a resin composition that has high thermal conductivity imparted thereto without increasing the amount of fillers to be blended, by orienting the fillers in a direction to which an electric field is applied, by using the electric field for the resin composition that is formed from a synthetic resin into which thermally-conductive fillers are charged. Here, orienting means an operation of aligning the long sides of the fillers having aspect ratios in the direction to which the electric field is applied.

However, according to the study of the present inventors, it is considered that in order to control the coefficient of thermal conductivity of the elastic layer according to Japanese Patent Application Laid-Open No. 2005-300591 to a value exceeding 1.5 W/(m·K), an amount of fillers to be blended in silicone rubber needs to be controlled to 60% by volume or more. In this case, it becomes difficult to achieve both further high thermal conductivity and low hardness.

In addition, the present inventors tried to adjust a softness of the elastic layer according to Japanese Patent Application Laid-Open No. 2005-300591 to, for example, 15° in JIS A hardness (JIS K6253), by controlling a volume amount of the fillers to be blended in the elastic layer to a value exceeding 50% by volume and also by reducing the amount of a cross-linking agent. As a result, there was a case where when such an elastic layer was repeatedly compressed in a state of being heated to a high temperature, for example, to 200° C., the elastic layer was broken or plastically deformed.

In the invention according to Japanese Patent Application Laid-Open No. 2007-101736, it was necessary to control the thickness of the elastic layer to approximately 1 to 5 mm, in order to orient the carbon fibers in the thickness direction, and it was difficult to improve the coefficient of thermal conductivity of such a fixing member as to have an elastic layer as thin as 500 μm or smaller.

Furthermore, when the technology disclosed in Japanese Patent Application Laid-Open No. 2013-159748 was applied to an elastic layer of a fixing member, all of the fillers were oriented in the thickness direction, which had been mixed in the state illustrated in FIG. 1A before the fillers were oriented, and became a state in which the fillers were oriented as illustrated in FIG. 1B. Because of this, the hardness became high; and such portions appeared in the elastic layer that the fillers were coarse and the fillers were dense, and the unevenness of the hardness occurred. Because of this, it was difficult to apply the technique to the fixing member.

SUMMARY OF THE INVENTION

One aspect of the present disclosure is directed to providing a fixing member having an elastic layer that is high in thermal conductivity in the thickness direction, resists causing fracture or plastic deformation even by repeated compression in a high temperature state, and is low in hardness.

In addition, another aspect of the present disclosure is directed to providing a heat fixing apparatus that contributes to formation of a high-quality electrophotographic image. Still another aspect of the present disclosure is directed to providing an image forming apparatus that can form a high-quality electrophotographic image.

According to one aspect of the present disclosure, there is provided an electrophotographic fixing member comprising: a substrate; and an elastic layer on an outer circumference of the substrate, the elastic layer containing fillers each of which contains an inorganic oxide, wherein (1) when a binarized image on a first cross-section in a thickness-circumferential direction of the elastic layer, and a binarized image on a second cross-section in a thickness-axial direction of the elastic layer are obtained, and when a shape of each of the fillers observed in the respective binarized images is approximated to an ellipse, among the fillers, an area proportion of a first fillers each having a major axis/minor axis of smaller than 1.5 is represented by A, and an area proportion of a second fillers each having a major axis/minor axis of 1.5 or larger is represented by B, A and B satisfy the following relation $1.0 \leq (A/B) \leq 2.0$ and $0.40 \leq (A+B) \leq 0.50$ are satisfied; and (2) an average orientation angle of the second fillers with respect to a thickness direction of the elastic layer is defined as $\theta_{Ave}$, $\theta_{Ave}$ is 50° or more and 90° or less.

According to another aspect of the present disclosure, there is provided a heat fixing apparatus having the above fixing member.

According to still another aspect of the present disclosure, there is provided an image forming apparatus including: a photosensitive member; a charging apparatus for charging the photosensitive member; an exposure apparatus for forming an electrostatic latent image by exposing the charged photosensitive member to light, a developing apparatus for developing the electrostatic latent image formed on the photosensitive member with a toner to form a toner image; a transfer apparatus for transferring the toner image formed on the photosensitive member to a recording medium; and the above heat fixing apparatus.

Further features of the present disclosure will become apparent from the following description of exemplary embodiments with reference to the attached drawings.

BRIEF DESCRIPTION OF THE DRAWINGS

FIG. 1A illustrates a state of unoriented fillers, and FIG. 1B illustrates one example of a state of conventionally oriented fillers.

FIG. 2A illustrates one example of a state of unoriented fillers, and FIG. 2B illustrates one example of a state of oriented fillers.

FIG. 4A illustrates a belt form, and FIG. 4B illustrates a roller form.

DESCRIPTION OF THE EMBODIMENTS

Figure 1A:
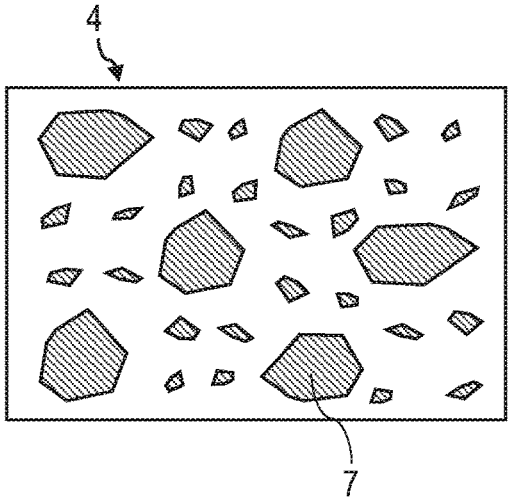
FIGS. 1A and 1B illustrate conceptual diagrams describing a state of fillers dispersed in an elastic layer in a conventional fixing member.

Preferred embodiments of the present disclosure will now be described in detail in accordance with the accompanying drawings.

A fixing member, a heat fixing apparatus and an image forming apparatus according to the present disclosure will be illustratively described below in detail with reference to the drawings. However, the technological scope according to the present disclosure is not limited to exemplary embodiments described below.

The present inventors have made studies for the purpose of obtaining a fixing member having an elastic layer that is high in thermal conductivity in the thickness direction, resists causing fracture or plastic deformation even by repeated compression in a high-temperature state, and is low in hardness. As a result, the present inventors have found that an elastic layer in which thermally-conductive fillers are dispersed in a particular state is effective for achieving the above purpose.

In a fixing apparatus for heating an unfixed toner image on a recording medium with an electrophotographic fixing member and for fixing the heated toner image onto the recording medium, a fixing member according to the present disclosure comes in contact with the unfixed toner image and heats the unfixed toner image.

The fixing member has at least a substrate, and an elastic layer provided on the outer circumference of the substrate and containing a filler containing an inorganic oxide. Then, (1) when a binarized image on a first cross-section in a thickness-circumferential direction of the elastic layer, and a binarized image on a second cross-section in a thickness-axial direction of the elastic layer are obtained, and assuming that a shape of each of the fillers observed in the respective binarized images is approximated to an ellipse, among the fillers, an area proportion of a fillers containing an inorganic oxide having a ratio of the major axis to the minor axis (major axis/minor axis) of smaller than 1.5 (hereinafter, also referred to as "first filler") is represented by A, and an area proportion of a filler containing the inorganic oxide having a major axis/minor axis of 1.5 or larger (hereinafter, also referred to as "second filler") is represented by B, A and B satisfy the following relation:

$$1.0 \leq (A/B) \leq 2.0 \text{ and } 0.40 \leq (A+B) \leq 0.50 \text{ are satisfied.}$$

In addition, (2) assuming that an average orientation angle of the second fillers with respect to a thickness direction of the elastic layer is defined as $\theta_{Ave}$, $\theta_{Ave}$ is 50° or more and 90° or less, i.e. $50° \leq \theta_{Ave} \leq 90°$.

It is preferable that the coefficient of thermal conductivity of the elastic layer in the thickness direction be 1.30 W/(m·K) or higher and lower than 2.00 W/(m·K).

The major axis/minor axis, the average orientation angle $\theta_{Ave}$ and the area proportion, assuming that the shape of the filler is approximated to an ellipse, can be determined by the image processing, which will be described later. Note that the area proportion is synonymous with a volume percentage of an amount of filler to be blended.

Figure 2A:
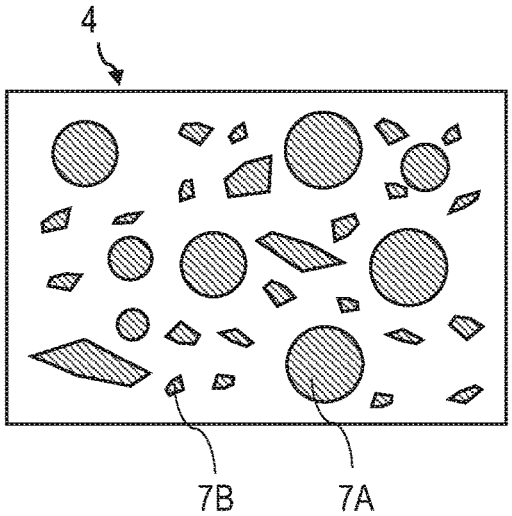
FIGS. 2A and 2B illustrate conceptual diagrams describing a state of fillers dispersed in an elastic layer according to the present disclosure.
Figure 2B:
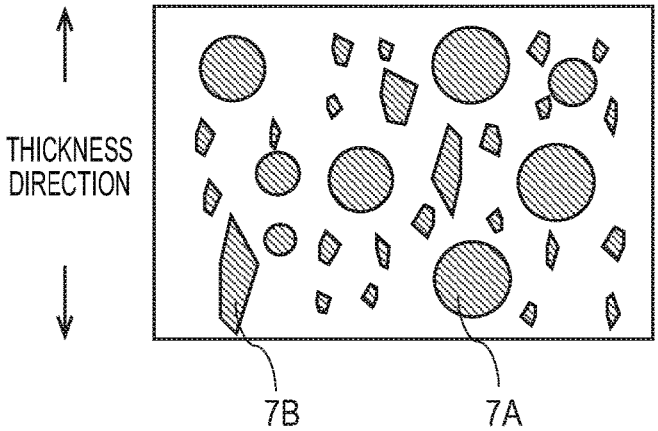

As is illustrated in FIG. 2B, the elastic layer according to the present disclosure contains a first filler having a ratio of the major axis to the minor axis (major axis/minor axis) of smaller than 1.5, assuming that the shape of the filler observed in the first cross-section and the second cross-section of the elastic layer is approximated to an ellipse, and a second filler having a major axis/minor axis of 1.5 or larger. Note that in the present specification, there is the case where the ratio of the major axis to the minor axis (major axis/minor axis) is referred to as "aspect ratio".

In addition, the second fillers having an aspect ratio of 1.5 or larger are oriented in the thickness direction of the elastic layer so that the average orientation angle $\theta_{Ave}$ is $50° \leq \theta_{Ave} \leq 90°$. Thereby, the thermal conductivity in the thickness direction can be sufficiently enhanced without excessively increasing a total content of the fillers in the elastic layer. In addition, the total content of the fillers is suppressed, and thereby an excessive increase in the hardness of the elastic layer can be suppressed. As a result, the elastic layer having both high thermal conductivity in the thickness direction and low hardness can be obtained. Note that in FIGS. 1A and 1B and FIGS. 2A and 2B, the vertical direction of the figures is the thickness direction of the elastic layer.

As a method of ellipse approximation, the approximation by the least-square method can be used.

A silicone rubber composition that contains the first filler having an aspect ratio of smaller than 1.5 can relatively alleviate a local stress generated on the interface between the filler and the silicone rubber even though a pressure may be applied from any direction, compared to a silicone composition that contains a second filler having the aspect ratio of 1.5 or larger. In addition, in the elastic layer in which the above "A/B" is in a range of 1.0 to 2.0, it is considered that the amount of the first fillers in the elastic layer is approximately the same as or larger than the amount of the second fillers. As a result, even in the case where a large strain is applied to the elastic layer, it is considered that stress concentration at least toward the vicinity of the interface between the first filler and the silicone rubber is alleviated, and the fracture originating from the interface between the filler and the silicone rubber, or the plastic deformation is effectively suppressed.

On the other hand, as a method for increasing the thermal conductivity in the thickness direction without increasing the amount of the thermally-conductive fillers to be blended in the elastic layer, there is a technology of orienting the filler by an external field such as a force field, a magnetic field and an electric field.

Materials that are generally used as the material of the thermally-conductive filler to be blended in the elastic layer of the fixing member are often amorphous inorganic oxides such as alumina, silica, zinc oxide and magnesium oxide, which have high affinity with orientation by the electric field driven by dielectric polarization. An orientation technology by an electric field disclosed in Japanese Patent Application Laid-Open No. 2013-159748 is a technology of sandwiching a curable liquid in which thermally-conductive fillers are dispersed, between parallel plate electrodes, applying an AC electric field thereto for several tens of minutes to several hours, and at the same time, curing the curable liquid by heat or the like. Thereby, a cured product is obtained in which the fillers are dielectrically migrated, and are oriented in the direction between the electrodes.

Figure 1B:
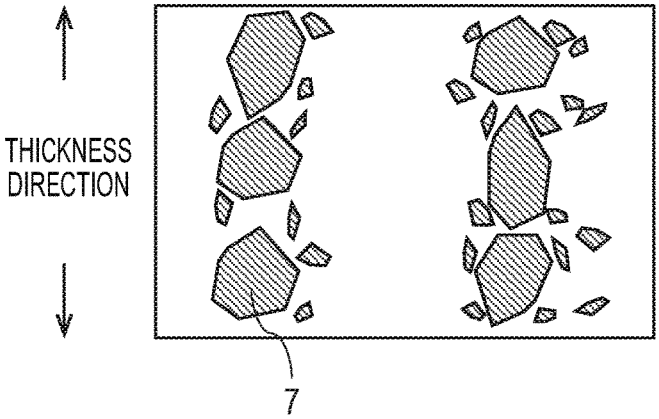

However, in the above method, there is a case where all of the blended fillers are oriented in the thickness direction, and consequently the hardness increases or becomes uneven, as illustrated in FIG. 1B.

On the other hand, in the elastic layer of the fixing member according to the present disclosure, which is formed through a step of applying electric charges to the outer surface of the uncured rubber composition layer, as will be described below, the orientation degree of the first fillers having a major axis/minor axis of smaller than 1.5, in the thickness direction of the elastic layer, is low.

Figure 3:
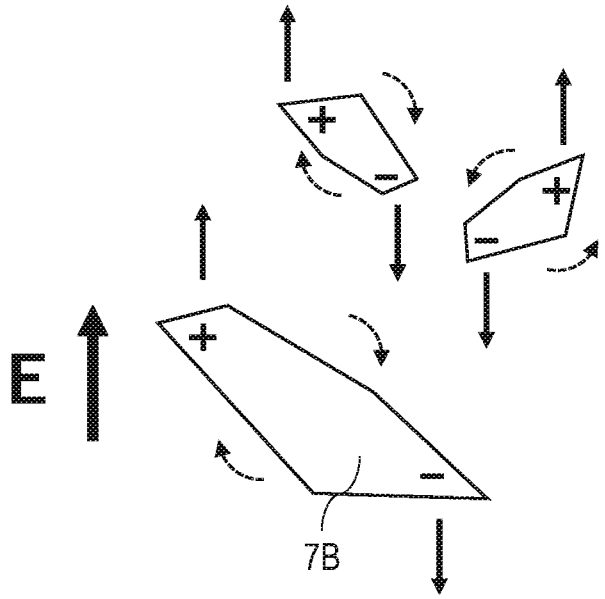
FIG. 3 illustrates a conceptual diagram relating to an orientation torque that is applied to the filler in the elastic layer.

On the other hand, the second fillers having a major axis/minor axis of 1.5 or larger are rotated by an orientation torque due to the dielectric polarization that occurs in the step of applying the electric charge to the outer surface of the uncured elastic layer, and are oriented, as illustrated in FIG. 3. As a result, the second fillers having a major axis/minor axis of 1.5 or larger change from the dispersed state illustrated in FIG. 2A to the dispersed state illustrated in FIG. 2B. Therefore, in the elastic layer after having been cured, the thermal conductivity is further improved by heat conduction paths that have been formed by the oriented second fillers having a major axis/minor axis of 1.5 or larger. Thereby, the high thermal conductivity in the thickness direction can be enhanced, while an increase in the content of the thermally-conductive filler in the elastic layer is suppressed. As a result, the flexibility of the elastic layer is also maintained.

The elastic layer according to the present disclosure can be manufactured, for example, according to the following method. A rubber composition layer containing a thermally-conductive filler and uncured rubber is formed on a base body, and then the surface of the rubber composition layer is charged before the rubber composition layer is cured. Thereby, the fillers contained in the rubber composition layer, being mainly amorphous, and having the aspect ratios being large are dielectrically polarized, and are oriented by receiving the torque. As a charging method, a non-contact method is preferable, and a corona charger is more preferable that can charge the fillers simply, inexpensively and substantially uniformly.

After that, the composition layer is cured. As a result, an elastic layer is formed in which the fillers having the aspect ratios being large are oriented in the thickness direction, and heat conduction paths are formed through which heat is efficiently transmitted.

In the elastic layer according to the present disclosure, a mechanism is not clear by which all the fillers are not oriented as illustrated in FIG. 1B, but the second fillers having a major axis/minor axis of 1.5 or larger are selectively migrated and oriented as illustrated in FIG. 2B; but is assumed to be as follows. Specifically, in a system in which sandwiching an elastic layer with parallelly disposed plate electrodes, and applying an electric field thereto, a dielectrophoretic phenomenon occurs on all the fillers due to the electric field applied by the electrodes. On the other hand, as to the elastic layer according to the present disclosure, an electric field has been applied by discharging in a non-contact method such as a corona charger in a short period of time, and accordingly it is assumed that such a strong force does not work as to dielectrically migrate the first fillers having a major axis/minor axis of smaller than 1.5.

Specific structures of a fixing member and a heat fixing apparatus according to one embodiment of the present disclosure will be described below in detail.

(1) Outline of Structure of Fixing Member

Details of the fixing member according to one aspect of the present disclosure will be described with reference to the drawings.

Figure 4A:
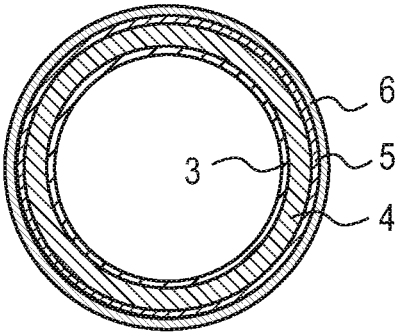
FIGS. 4A and 4B illustrate rough schematic cross-sectional views of a fixing member according to an embodiment of the present disclosure.
Figure 4B:
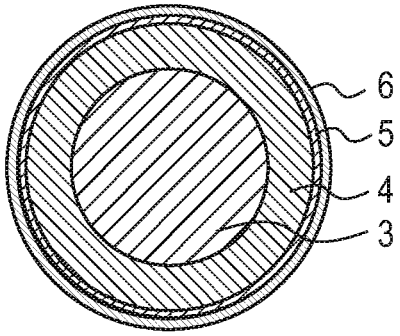

FIG. 4A and FIG. 4B illustrate rough schematic cross-sectional views illustrating the fixing member according to the present aspect. FIG. 4A illustrates a cross-section of a fixing member having an endless shape (hereinafter, also referred to as a "fixing belt") in a direction orthogonal to a circumferential direction; and FIG. 4B illustrates a cross-section of a fixing member having a roller shape (hereinafter, also referred to as a "fixing roll") in a direction orthogonal to the circumferential direction. Note that the endless shape means a shape in which the fixing belt rotationally moves in the circumferential direction and thereby the same portion can pass through a fixing nip part many times (endlessly).

In FIG. 4A and FIG. 4B, an elastic layer 4 containing silicone rubber covers the outer circumferential surface of a base body 3. In FIG. 4A and FIG. 4B, the radial direction is the thickness direction of the elastic layer.

Thus, the fixing member according to the present embodiment includes the base body 3 and the elastic layer 4 including the silicone rubber on the base body 3.

In addition, as illustrated in these figures, the fixing member can have a surface layer 6 on the elastic layer 4 containing silicone rubber.

In addition, the fixing member may also have an adhesive layer 5 between the elastic layer 4 containing the silicone rubber and the surface layer 6, and in this case, the surface layer 6 is fixed on the outer circumferential surface of the elastic layer 4 containing the silicone rubber, by the adhesive layer 5.

(2) Base Body of Fixing Member

The base body 3 used for the fixing belt illustrated in FIG. 4A includes: a base body with an endless shape, that contains a metal such as nickel and stainless steel; and a base body with an endless shape, that contains a resin such as polyimide.

Here, when the electromagnetic induction heating method is employed for heating the fixing belt, a base body mainly containing nickel or iron is preferably used, which shows high exothermic efficiency.

On the outer surface of the base body 3 (surface on the elastic layer side), a layer can be provided for imparting a function of improving the adhesiveness with the elastic layer. Specifically, the elastic layer 4 may be provided on the outer circumferential surface of the base body 3, and another layer can be provided between the elastic layer 4 and the base body 3. In addition, a layer for imparting functions such as wear resistance and lubricity can be further provided on the inner surface of the base body 3 (surface opposite to the above outer surface). Note that in the case of a belt form, a core is inserted into a sleeve, and the resultant sleeve is handled, in the following manufacturing process.

The base body 3 used for the fixing roller illustrated in FIG. 4B includes a shaft core (hereinafter also referred to as core metal) made of metal such as aluminum or iron, or of an alloy thereof. The base body 3 used for the fixing roller is required to have such a strength as to be capable of withstanding a pressure to be applied when the pressing member presses the fixing roller in the heat fixing apparatus. The base body 3 of the fixing roll illustrated in FIG. 4B is a solid core metal, but a hollow shaft core can be employed as well. When the hollow shaft core is used, a heat source such as a halogen lamp can be arranged in the inner part thereof.

(3-1) Elastic Layer Containing Silicone Rubber

The elastic layer 4 containing silicone rubber functions as a layer for imparting such excellent flexibility to the fixing member that the fixing member can follow the irregularities of the paper at the time of fixing. The silicone rubber is preferable because of having such high heat resistance as to be capable of keeping flexibility even in an environment at a high temperature of approximately 240° C. in a non-paper passing area. In addition, it is preferable that the silicone rubber be electrically insulative, because before the rubber is cured, the surface is charged so that the fillers are oriented. As such a silicone rubber, for example, a cured product of an addition-curable type of liquid silicone rubber can be used, as will be described later.

The elastic layer 4 containing the silicone rubber contains a thermally-conductive filler in order to improve the thermal conductivity in the thickness direction of the elastic layer.

The type of the filler is selected in consideration of the coefficient of thermal conductivity, specific heat capacity, density, a particle size, a shape, a relative dielectric constant and the like of the filler itself. Materials for the thermally-conductive filler include alumina ($Al_2O_3$), zinc oxide (ZnO), magnesium oxide (MgO) and silica ($SiO_2$). These fillers may be used alone or may be used in combination.

In addition, a metal filler and a carbon fiber filler have low electric resistance values, and resist causing dielectric polarization when an electric field is applied; and are not suitable for use alone. However, this is not the case when the electric resistance value can be controlled by a surface treatment being performed for forming an oxide film.

The filler may be subjected to surface treatment, from the viewpoint of controlling the affinity to silicone that is a base material, and an electrical resistance value to desired values. Specifically, materials such as alumina, silica and magnesium oxide, which have an active group like a hydroxyl group on the surface of the filler, are surface-treated by a silane coupling agent, hexamethyl disilazane or the like.

Assuming that the shape of the filler in the elastic layer is approximated to an ellipse, among the fillers containing the inorganic oxide, the area proportion of the first fillers having a major axis/minor axis of smaller than 1.5 is represented by A, and the area proportion of the second fillers having a major axis/minor axis of 1.5 or larger is represented by B, $$1.0 \leq (A/B) \leq 2.0 \text{ and } 0.40 \leq (A+B) \leq 0.50 \text{ are satisfied.}$$

As described above, in the case where (A/B) is 1.0 to 2.0, even when a large strain is applied to the elastic layer, the elastic layer resists causing the fracture that occurs from the vicinity of the interface between the filler and the silicone rubber, or the elastic layer resists causing plastic deformation of itself. Because of this, the elastic layer can exhibit high durability. This is considered to be because the fillers having a shape close to a sphere, and having a major axis/minor axis of smaller than 1.5, are contained at a predetermined proportion of all fillers, which leads to the alleviation of a local stress that is generated on the interface between the filler and the silicone rubber, even when a strain is applied from any direction to the elastic layer.

In addition, among the fillers in the elastic layer according to the present aspect, the second fillers having a major axis/minor axis of 1.5 or larger are oriented so that the average orientation angle $\theta_{Ave}$ with respect to the thickness direction of the elastic layer is $50° \leq \theta_{Ave} \leq 90°$. Thereby, the thermal conductivity in the thickness direction can be enhanced without excessively increasing the total amount of fillers in the elastic layer. As a result, a fixing member can be obtained in which the thermal conductivity in the thickness direction is enhanced without causing an excessive increase in the hardness thereof.

The area proportions A and B of respective filler groups in the elastic layer are ratios to the volume of the mixture (elastic layer) of the silicone rubber and the fillers, and is represented by a value of 0 to 1 (0 to 100% by volume).

The ratio of the area proportion (A/B) of the respective filler groups in the elastic layer is set at 1 or larger and 2 or smaller. When A/B is smaller than 1, durability is poor in some cases. In addition, when A/B exceeds 2, the coefficient of thermal conductivity is poor in some cases.

The sum (A+B) of the area proportions of the respective filler groups in the elastic layer is set at 0.4 or larger and 0.5 or smaller. By A+B being set at 0.4 or larger, the thermal conductivity of the elastic layer can be expected to be high, and by A+B being set at 0.5 or smaller, an excessive increase in the hardness of the elastic layer can be suppressed.

Examples of the first filler having a major axis/minor axis of smaller than 1.5 include the following products, which are commercially available. The products are "Alunabeads CB" (trade name, manufactured by Showa Denko K.K.) for alumina, "LPZINC" (trade name, manufactured by Sakai Chemical Industry Co., Ltd.) for zinc oxide, "SL-WR" (trade name, manufactured by Konoshima Chemical Co., Ltd.) for magnesium oxide, and "Tospearl" (trade name, manufactured by Momentive Performance Materials Inc.) for silicon oxide (silica).

In addition, examples of the second filler having a major axis/minor axis of 1.5 or larger include the following products.

The products are "LS-130" (trade name, manufactured by Nippon Light Metal Company, Ltd.) for alumina, "Pana-Tetra WZ-05F1" (trade name, manufactured by Amtec Co., Ltd.) for zinc oxide, "RF-10C-FC" (trade name, manufactured by Ube Material Industries, Ltd.) for magnesium oxide, and "S6-5" (trade name, manufactured by Marutou Co., Ltd.) for silicon oxide (silica).

In other words, it is preferable that the filler containing the inorganic oxide according to the present disclosure be at least one selected from the group consisting of alumina, zinc oxide, magnesium oxide and silicon oxide.

In addition, the shape of the filler powder may be adjusted by heretofore known spheroidizing treatment (mechanical spheroidizing treatment or technique of spheroidizing accompanying melting in high-temperature atmosphere), pulverizing treatment, or the like.

The area proportion of the fillers measured in the first cross-section and the second cross-section of the elastic layer corresponds to a volume proportion of the fillers in the elastic layer, and can be adjusted by adjustment of a volumetric blending proportion between the first filler having a major axis/minor axis of smaller than 1.5 and the second filler having a major axis/minor axis of 1.5 or larger. However, if the exact shape distribution is not known, the ratio of the area proportion is finally calculated by the image processing, which will be described later.

The elastic layer containing silicone rubber can be formed, for example, by curing an addition-curable type of liquid silicone rubber composition (unvulcanized rubber composition) that contains an addition-curable type of liquid silicone rubber (unvulcanized rubber) and a filler.

The addition-curable type of liquid silicone rubber can contain: (a) organopolysiloxane having an unsaturated aliphatic group; (b) organopolysiloxane having active hydrogen that is bonded to silicon; (c) a catalyst (for example, platinum compound); and (d) a cure retarder.

(a) functions as a cross-linking point at the time of the curing reaction. (b) is a cross-linking agent. (c) is a catalyst for accelerating the curing reaction. (d) is an inhibitor (cure retarder) for controlling the reaction initiating time.

Furthermore, in addition to these chemical components, a filler suitable for each purpose can also be kneaded and dispersed so as to impart heat resistance, reinforcing properties and the like. Hereinafter, (a) to (d) will be described.

(a) Organopolysiloxane Having Unsaturated Aliphatic Group

As the organopolysiloxane having an unsaturated aliphatic group (hereinafter, sometimes referred to as component a), any organopolysiloxane can be used as long as the organopolysiloxane has an unsaturated aliphatic group such as a vinyl group. For example, components represented by the following formulas 1 and 2 can be used as component a.

Straight-chain organopolysiloxane that has one or both of intermediate units selected from the group consisting of an intermediate unit represented by $R_1R_1SiO$ and an intermediate unit represented by $R_1R_2SiO$, and a molecular terminal represented by $R_1R_1R_2SiO_{1/2}$ (see the following formula 1).

[Formula 1]

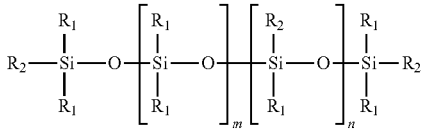

Straight-chain organopolysiloxane that has one or both of intermediate units selected from the group consisting of an intermediate unit represented by $R_1R_1SiO$ and an intermediate unit represented by $R_1R_2SiO$, and a molecular terminal represented by $R_1R_1R_1SiO_{1/2}$ (see the following formula 2).

[Formula 2]

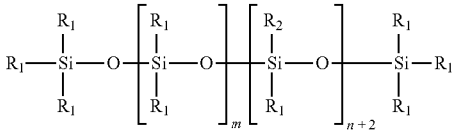

(In the formulas 1 and 2, $R_1$ each independently represents an unsubstituted hydrocarbon group that does not contain an unsaturated aliphatic group, $R_2$ each independently represents an unsaturated aliphatic group, and m and n each independently represent an integer of 0 or larger.)

In addition, examples of the unsubstituted hydrocarbon group represented by $R_1$ in formulas 1 and 2, which does not contain an unsaturated aliphatic group, include, for example, a methyl group, an ethyl group and a propyl group, and an aryl group (for example, a phenyl group). Particularly preferable is a methyl group.

In addition, in formulas 1 and 2, examples of the unsaturated aliphatic group represented by $R_2$ include a vinyl group, an allyl group and a 3-butenyl group, and it is preferable that the unsaturated aliphatic group be the vinyl group.

In the formula 1, the straight-chain organosiloxane of n=0 has an unsaturated aliphatic group only at both terminals, and the straight-chain organosiloxane of n=1 or more has unsaturated aliphatic groups at both terminals and a side chain. In addition, the straight-chain organosiloxane in the formula 2 has an unsaturated aliphatic group only in the side chain. As component a, one type may be used alone, or two or more types may be used in combination.

In addition, when component a is used for the elastic layer of the fixing member, it is preferable that the viscosity be 100 $mm^2/s$ or higher and 50000 $mm^2/s$ or lower, from the viewpoint of being excellent in formability. The viscosity (kinematic viscosity) can be measured with the use of a capillary viscometer, a rotational viscometer or the like, according to JIS Z 8803:2011. In addition, when commercially available component a is used, catalog values can serve as a reference.

(b) Organopolysiloxane Having Active Hydrogen that is Bonded to Silicon (Cross-Linking Agent)

Organopolysiloxane having active hydrogen that is bonded to silicon (hereinafter, sometimes referred to as component b) is a cross-linking agent that forms a cross-linked structure through a reaction with an unsaturated aliphatic group in component a, due to a catalytic action of a platinum compound.

Any organopolysiloxane can be used as component b, as long as the organopolysiloxane has a Si—H bond, and, for example, those satisfying the following conditions can be suitably used. In addition, as for component b, one type may be used alone, or two or more types may be used in combination.

- Organopolysiloxane having the number of hydrogen atoms bonded to silicon atoms is 3 or more per molecule on average, from the viewpoint of promoting the formation of a cross-linked structure by the reaction with the organopolysiloxane having the unsaturated aliphatic group.
- The organic group bonded to the silicon atom can include the unsubstituted hydrocarbon group, for example, those as described above, and is preferably the methyl group.
- A siloxane skeleton (—Si—O—Si—) may be any of a straight-chain form, a branched form and a cyclic form.
- The Si—H bond may exist in any siloxane unit in the molecule.

For example, straight-chain organopolysiloxanes represented by the following formulas 3 and 4 can be used as component b.

[Formula 3]

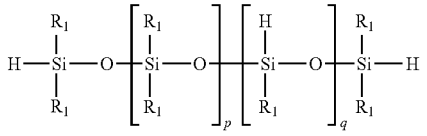

[Formula 4]

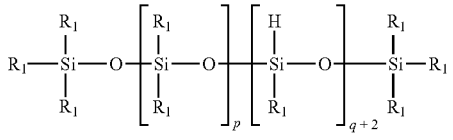

(In the formulas 3 and 4, $R_1$ each independently represents an unsubstituted hydrocarbon group that does not contain an unsaturated aliphatic group, p represents an integer of 0 or larger, and q represents an integer of 1 or larger.)

In addition, as described in the formulas 1 and 2, $R_1$ is an unsubstituted hydrocarbon group that does not contain an unsaturated aliphatic group, and is preferably the methyl group.

(c) Catalyst

As a hydrosilylation (addition curing) catalyst, a platinum compound can be used, for example. Specific examples include a platinum carbonyl cyclovinylmethylsiloxane complex and a 1,3-divinyl tetramethyldisiloxane platinum complex. Hereinafter, the catalyst is referred to as component c in some cases.

(d) Cure Retarder

An agent that is referred to as a cure retarder can be blended, in order to adjust a rate of curing reaction in hydrosilylation (addition curing). Specific examples can include 2-methyl-3-butyn-2-ol and 1-ethynyl-1-cyclohexanol. Hereinafter, the cure retarder is sometimes referred to as component d.

The elastic modulus of the elastic layer containing the silicone rubber can be adjusted to some extent, by the type and amount of component (a) to be blended, the type and amount of component (b) to be blended, the type and amount of component (c) to be blended, and the type and amount of component (d) to be blended. It is more preferable that the elastic layer containing the silicone rubber have a (tensile) elastic modulus of 0.20 MPa or larger and 1.20 MPa or smaller. When the elastic modulus of the elastic layer is within this range, the hardness of the elastic layer becomes low (soft), and a high-quality image can be obtained. In addition, due to the elastic modulus being set at 0.2 MPa or larger, the elastic layer can be prevented from being deformed, when an excess addition-curable silicone rubber adhesive is threshed in a manufacturing process of the fixing member, which will be described later.

The composition of the silicone rubber contained in the elastic layer can be confirmed by the measurement of total reflection (ATR) with the use of an infrared spectrometer (FT-IR) (for example, product name: Frontier FT IR, manufactured by PerkinElmer Inc.). A silicon-oxygen bond (Si—O), which is a main chain structure of silicone, shows strong infrared absorption in the vicinity of a wave number of 1020 $cm^{-1}$, due to its stretching vibration. Furthermore, a methyl group (Si—$CH_3$) bonded to the silicon atom shows strong infrared absorption in the vicinity of a wave number of 1260 $cm^{-1}$, due to its bending vibration originating in the structure, and accordingly, the existence can be confirmed.

Contents of the cured silicone rubber and the filler in the elastic layer can be confirmed with the use of an apparatus for thermogravimetry (TGA) (for example, trade name: TGA851, manufactured by Mettler-Toledo International Inc.). The elastic layer is cut out with a razor or the like, and about 20 mg is accurately weighed and is placed in an alumina pan that is used for the apparatus. The alumina pan containing the sample is set in the apparatus, is heated under a nitrogen atmosphere, from room temperature to 800° C. at a rate of temperature rise of 20° C./min, and is further kept at the temperature of 800° C. for 1 hour. In the nitrogen atmosphere, the cured silicone rubber component is not oxidized even though the temperature has risen, but is decomposed and removed by cracking, and accordingly, the mass of the sample decreases. Thus, masses before and after the measurement are compared, and thereby the content of the cured silicone rubber component and the content of the filler can be confirmed that have been contained in the elastic layer.

(3-2) Step of Applying Electric Field to Elastic Layer

A corona charger and a step of applying an electric field to an elastic layer using the same will be described as one embodiment below. In corona charging methods, there are a scorotron method which has a grid electrode between a corona wire and an object to be charged, and a corotron method which does not have the grid electrode, and the scorotron method is preferable from the viewpoint of being excellent in controllability of a surface potential of the object to be charged.

Figure 5A:
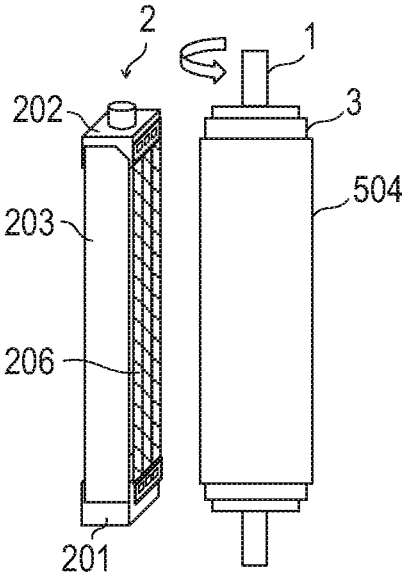
FIGS. 5A and 5B illustrate an overhead view and a cross-sectional view of a corona charger for forming an elastic layer of a fixing member according to an embodiment of the present disclosure.
Figure 5B:
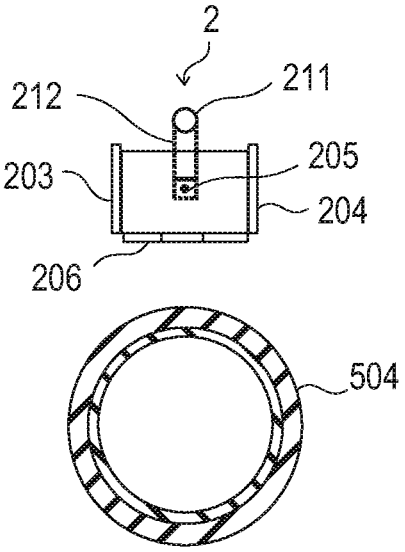

As illustrated in FIG. 5A and FIG. 5B, a corona charger 2 includes a front block 201, a back block 202, and shields 203 and 204. In addition, a discharge wire 205 is stretched between the front block 201 and the back block 202, and when a charging bias is applied thereto by a high voltage power supply, the discharge wire 205 discharges and charges the surface of the elastic layer 4 on the base body, which is the object to be charged and is uncured.

A high voltage is applied to the discharge wire 205 that functions as a discharge member, in the same manner as that in the structure of a general corona charger. Then, an ion flow resulting from a discharge to the shields 203 and 204 is controlled by applying a high voltage to a grid 206, and thus a surface potential of the elastic layer 4 is controlled to a predetermined potential. At this time, the base body 3 or the core 1, which holds the base body 3, is grounded (not illustrated), and accordingly, by controlling the surface potential of the surface of the elastic layer 4, the grid can generate a desired electric field in the elastic layer 4.

The method for manufacturing the fixing member of the above embodiment will be described in detail below. Firstly, a layer of an addition-curable type of the liquid silicone rubber composition that contains the first filler and the second filler (hereinafter, also referred to as a "composition layer") 504 is formed on the base body 3. Next, as illustrated in FIG. 5A, the corona charger 2 is arranged along the width direction of the composition layer 504 so as to be close and opposite to the composition layer. Then, a voltage is applied to the grid 206 of the corona charger 2, and in such a state that the corona charger is discharged, the base body 3 is rotated at 100 rpm for 20 seconds, for example. Thus, the surface of the composition layer 504 is charged. The distance between the surface of the composition layer 504 and the grid 206 can be set at 1 mm to 10 mm Due to the surface of the composition layer 504 being charged in this way, an electric field is generated in the composition layer 504, and the second fillers having a major axis/minor axis of 1.5 or larger, in particular, are dielectrically polarized. As a result, the second fillers receive the torque and are oriented in the thickness direction of the composition layer 504. Then, the composition layer 504 is cured, and the elastic layer 4 is obtained in which the orientations of the second fillers are fixed.

It is preferable that an absolute value of the voltage to be applied to the grid 206 be controlled in a range of 0.3 kV to 3 kV, from the viewpoint of generating an electrostatic interaction effective for the second filler. In the case where the amorphous fillers are oriented in the thickness direction of the composition layer 504 with the use of the electric field, it is important to generate the electric field in the thickness direction of the composition layer 504.

The sign of the voltage applied to the grid may be negative or positive, as long as the sign of the voltage applied to the grid is same as the sign of the voltage applied to the wire. Though the direction of the electric field will be reversed, the effects to be obtained are the same. There is the case where depending on the type of the thermally-conductive filler, the amorphous fillers resist being oriented. In this case, it is preferable to increase the voltage to be applied to the grid 206. This is assumed to be related to the dielectric constants of the silicone rubber component and the thermally-conductive filler. When the difference between the dielectric constants of the silicone rubber and the filler is large, the second fillers can be oriented by a relatively small applied voltage. On the other hand, if the voltage applied to the grid 206 is too high, the electrostatic repulsion due to the surface charge of the composition layer 504 increases, thereby a flow of a liquid level occurs, and the surface properties of the composition layer 504 are lowered in some cases. Accordingly, an absolute value of the voltage applied to the grid 206 is more preferably in a range of 0.6 kV to 2 kV.

It is preferable that a range of the potential control in the longitudinal direction of the surface of the composition 504 be wider than the paper passing area of the fixing member. For example, a configuration illustrated in FIG. 5A can be used, and while the voltage is applied to the grid 206, the core 1 is rotated around the central axis of the core 1, and thereby the whole of the composition 504 can be charged. In addition, it is preferable that the rotation speed of the fixing belt be 10 rpm to 500 rpm, and the processing time period be 5 seconds or longer, from the viewpoint of stably orienting the second fillers. Thus, due to the surface potential of the composition layer 504 being controlled, the degree of orientation of the second fillers can be controlled.

As the discharge wire 205, stainless steel, nickel, molybdenum, tungsten or the like may be used, but it is preferable to use tungsten, which is extremely high in stability among metals. In addition, the discharge wire stretched inside the shields may have a circular cross-sectional shape or a shape like a saw tooth.

A diameter of the discharge wire 205 is preferably 40 μm to 100 μm. Due to the diameter of the discharge wire being set in such a range, a breakage of the discharge wire can be suppressed, which may occur due to ions at the time of discharge, and it is not necessary to excessively increase the voltage required for causing corona discharge. As the voltage applied to the discharge wire 205, either a DC voltage or an AC voltage can be used. In the case of the AC voltage, it is preferable to employ a frequency of approximately 1 Hz to 1000 Hz. The voltage having a waveform such as a rectangular wave and a sine wave can be output from an arbitrary waveform generator.

(3-3) Method for Confirming Average Orientation Angle $\theta_{Ave}$ of Fillers in Elastic Layer The average orientation angle $\theta_{Ave}$ of the second fillers in the elastic layer can be confirmed by an image analysis that is performed with the use of a binarized image obtained from a cross-sectional image of the elastic layer.

As a prior preparation, a cross section for measurement is formed.

Figure 6:
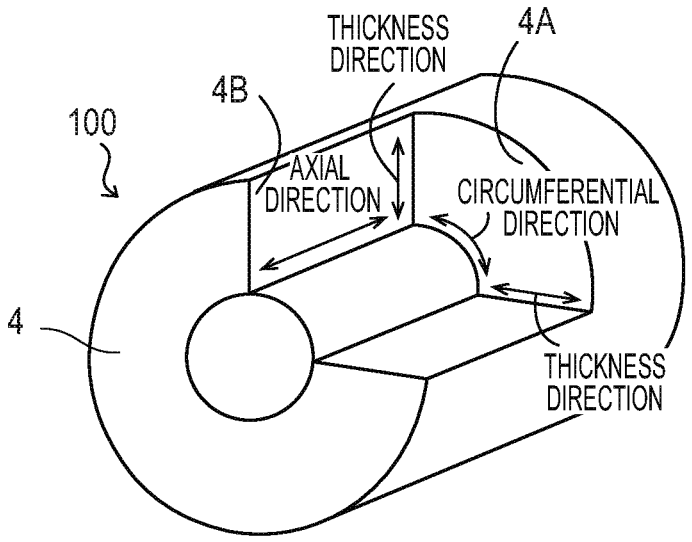
FIG. 6 illustrates a view illustrating a first cross-section and a second cross-section of an elastic layer of the fixing member having the roller form illustrated in FIGS. 4A and 4B.

It is preferable to obtain five cross-section sample pieces beforehand each from the first cross-section 4A in the thickness direction-circumferential direction (also described as "thickness-circumferential direction") of the elastic layer 4, and from the second cross-section 4B in the thickness direction-axial direction (also described as "thickness-axial direction") illustrated in FIG. 6, with a sharp knife, scissors or the like. After that, it is preferable to use a cross-section forming method with the use of an ion beam. Due to the cross-section forming method with the use of the ion beam, it can be prevented that fillers exfoliate and an extra component such as an abrading agent gets mixed, which are apt to occur in cross-section polishing processing, and furthermore, a cross section with few polishing marks can be formed. For the cross-section forming process by the ion beam, a cross-section polisher can be used as one example.

Figure 7A:
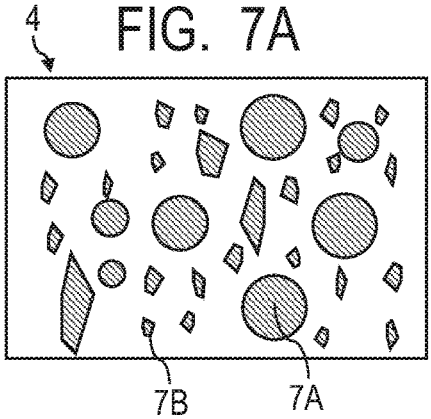
FIGS. 7A, 7B, 7C, 7D and 7E (7E1, 7E2, 7E3 and 7E4) illustrate schematic views illustrating a method for confirming an average orientation angle $\theta_{Ave}$ of fillers in an elastic layer.

Next, the obtained cross-section is observed with a laser microscope, scanning electron microscope (SEM) or the like, and a cross-sectional image of a 150 μm×100 μm region is acquired (FIG. 7A).

Figure 7B:
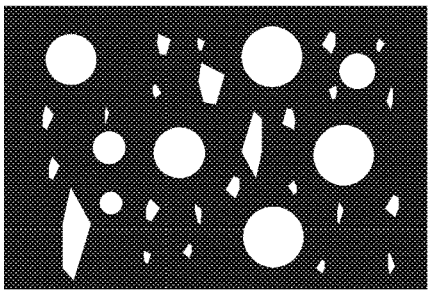

The obtained image is subjected to such black and white binarization processing that the filler portion becomes white and the silicone rubber portion becomes black, with the use of commercially available image software (FIG. 7B). As the binarization method, for example, the Otsu method can be used.

Figure 7C:
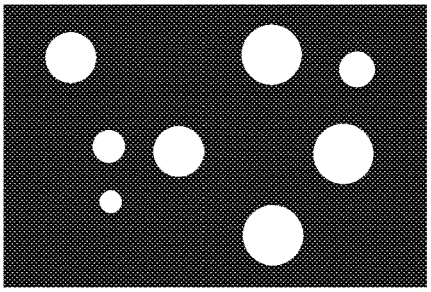
Figure 7D:
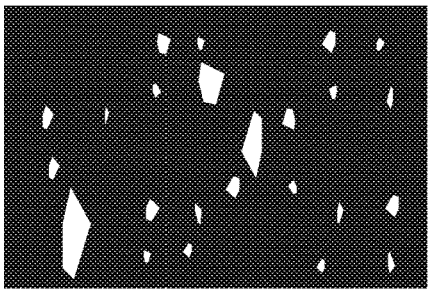

In the obtained binarized image, fillers 7A and 7B are each subjected to ellipse approximation; then a first image of which only the fillers 7A having a major axis/minor axis of smaller than 1.5 are left (FIG. 7C), and a second image of which only the fillers 7B having a major axis/minor axis of 1.5 or larger are left (FIG. 7D) are obtained. Note that FIG. 7D illustrates an image of the fillers 7B having a major axis/minor axis of 1.5 or larger when having been subjected to the ellipse approximation, before the ellipse approximation.

Then, from the first and the second images, A/B is calculated, where A represents an area proportion of the first fillers 7A having a major axis/minor axis of smaller than 1.5, and B represents an area proportion of the second fillers 7B having a major axis/minor axis of 1.5 or larger.

Figure 7E:
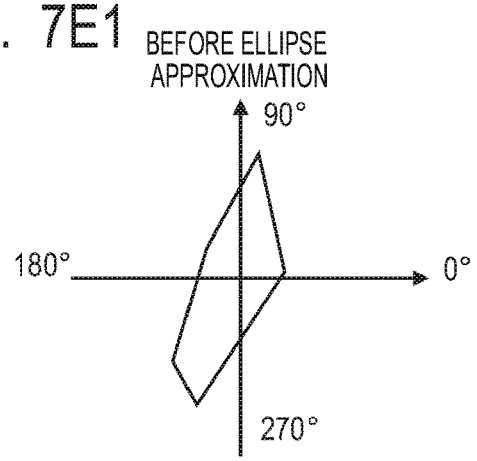
Figure 7E:
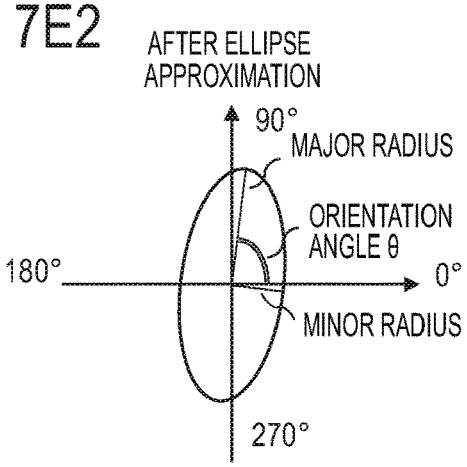
Figure 7E:
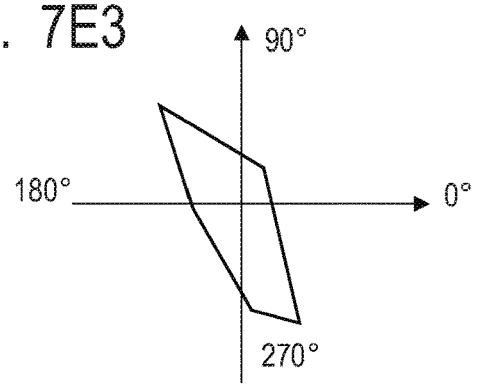
Figure 7E:
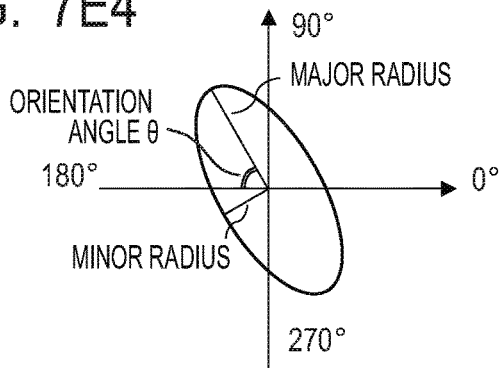

Furthermore, an orientation angle of each filler is calculated by image analysis based on the filler image (FIG. 7D) where only the fillers having a major axis/minor axis of 1.5 or larger are left when having been subjected to the ellipse approximation. The orientation angle θ represents an angle to be formed when the circumferential direction is defined as 0° (while the thickness direction is defined as 90°) in the first cross-section 4A in the thickness-circumferential direction of the elastic layer, and when the axial direction is defined as 0° in the second cross-section 4B in the thickness-axial direction. Specifically, when an angle from 0° to the major radius is 90° or smaller, the angle is defined as the orientation angle θ (FIG. 7E2), and when an angle from 0° to the major radius exceeds 90°, the angle from the major radius to 180° is defined as the orientation angle θ (FIG. 7E4). Thus, the orientation angle θ is defined in a range of 0 to 90° (FIG. 7E2 and FIG. 7E4). Accordingly, the closer the orientation angle is to 90°, the more the filler is oriented in the thickness direction.

The area proportion of the fillers is determined to be an average value of the area proportions of the fillers of 10 spots in total of 5 spots in each of the first cross-section 4A in the thickness-circumferential direction and the second cross-section 4B in the thickness-axial direction of the elastic layer. Similarly, the average orientation angle $\theta_{Ave}$ is also determined to be the average value of the orientation angles θ of 10 spots in total of 5 spots in each of the first cross-section 4A in the thickness-circumferential direction and the second cross-section 4B in the thickness-axial direction of the elastic layer. The area proportion of the fillers is synonymous with the volumetric blending proportion of the fillers. Because of this, by the adjustment of the blending ratio between the spherical filler and the amorphous filler, the volumetric blending proportion (ratio of area proportion) between the filler having a major axis/minor axis of smaller than 1.5 and the filler having a major axis/minor axis of 1.5 or larger can be adjusted. However, if the exact shape distribution is not known, the ratio of the area proportion is finally calculated by the image processing.

The ratio of the area proportion (A/B) of the respective fillers in the elastic layer is set at 1 or larger and 2 or smaller. When the ratio of the area proportion (A/B) is smaller than 1, durability is poor in some cases. When the ratio of the area proportion (A/B) exceeds 2, the coefficient of thermal conductivity is poor in some cases.

The sum (A+B) of the area proportions of the respective fillers in the elastic layer is set at 0.4 or larger and 0.5 or smaller. Due to the sum of the area proportions (A+B) being set at 0.4 or larger, the thermal conductivity of the elastic layer can be expected to be high, and due to the sum of the area proportions (A+B) being set at 0.5 or smaller, low hardness of the elastic layer can be secured.

The average orientation angle $\theta_{Ave}$ of the fillers having a major axis/minor axis of 1.5 or larger is controlled to 50° or larger and 90° or smaller. The direction of 90° coincides the thickness direction of the elastic layer, and accordingly as the average orientation angle is closer to 90°, the fillers are oriented more in the thickness direction. Because of this, due to the average orientation angle $\theta_{Ave}$ of the filler being controlled to 50° or larger and 90° or smaller, the thermal conductivity in the thickness direction can be enhanced.

The coefficient of thermal conductivity λ in the thickness direction of the elastic layer can be calculated from the following expression.

$$\lambda=\alpha\times C_p\times\rho$$

Here, λ represents the coefficient of thermal conductivity in the thickness direction of the elastic layer (W/(m·K)), α represents the coefficient of thermal diffusivity in the thickness direction ($m^2/s$), $C_p$ represents the specific heat at constant pressure (J/(kg·K)), and ρ represents density ($kg/m^3$). In addition, the method for measuring each parameter will be described in detail in Examples.

In addition, there is hardness or tensile modulus of elasticity as a criterion for evaluating the flexibility of the elastic layer.

The hardness can be measured, for example, according to Japanese Industrial Standards (JIS) K7312, or by the use of a micro rubber hardness meter (MD-1TYPE-C hardness meter, manufactured by Kobunshi Keiki Co., Ltd.).

As for the tensile modulus of elasticity, a sample piece is cut out from the elastic layer by a punching die (dumbbell-shaped No. 8 type, which is specified in JIS K6251:2004), and the thickness of a measurement spot is measured. Next, the cut sample piece is stretched by the use of, for example, a tensile tester (device name: Strograph EII-L1, manufactured by Toyo Seiki Seisaku-sho, Ltd.) at room temperature at a tensile speed of 200 mm/min, and thereby the tensile stress can be measured. Note that the tensile modulus of elasticity is determined to be an inclination at the time when a graph is created in which the strain of the sample piece is taken on the horizontal axis and the measured tensile stress is taken on the vertical axis, from the measurement results, and the measured data is linearly approximated in such a range that the strain is 0 to 10%.

When the coefficient of thermal conductivity in the thickness direction of the elastic layer is controlled to 1.30 W/(m·K) or larger, satisfactory fixing can be performed. In addition, when the coefficient of thermal conductivity is controlled to 2.00 W/(m·K) or larger, the hardness becomes higher in some cases, and accordingly, the coefficient of thermal conductivity is preferably smaller than 2.00 W/(m·K).

(4) Adhesive Layer of Fixing Member

The adhesive layer 5 illustrated in FIGS. 4A and 4B is a layer of an adhesive for bonding the elastic layer 4 and the surface layer (mold releasing layer) 6 to each other. As the adhesive, an adhesive agent containing an addition-curable type of liquid silicone rubber composition in which a self-adhesive component is contained may preferably be employed. Specifically, the addition-curable type of liquid silicone rubber composition may contain organopolysiloxane that has a plurality of unsaturated aliphatic groups represented by a vinyl group in its molecular chain, hydrogenorganopolysiloxane and a platinum compound that functions as a cross-linking catalyst; and is cured by an addition reaction. A known adhesive can be used as such an adhesive.

Examples of self-adhesive components include the following:

- Silane having at least one, and preferably, two or more functional groups selected from the group consisting of an alkenyl group such as a vinyl group, an acryloxy group, a methacryloxy group, a hydrosilyl group (SiH group), an epoxy group, an alkoxysilyl group, a carbonyl group and a phenol group;
- A cyclic or straight-chain organosilicon compound such as siloxane having 2 or more and 30 or less silicon atoms, preferably, 4 or more and 20 or less silicon atoms; and
- A non-silicon-based (in other words, containing no silicon atom in the molecule) organic compound that may contain an oxygen atom in the molecule. The organic compound may preferably contain one or more and four or less, more preferably, one or more and two or less aromatic ring(s) such as a monovalent or more and tetravalent or less, preferably, divalent or more and tetravalent or less phenylene structure: and also may preferably contain at least one, more preferably, two or more and four or less functional groups (for instance, alkenyl group, acryloxy group and methacryloxy group), which can contribute to a hydrosilylation addition reaction, in one molecule.

The above self-adhesive components can be used alone, or also in combination with other one or more types. A filler component can be added to the adhesive in such a range as to comply with the gist of the present disclosure, from the viewpoint of adjusting the viscosity and/or securing heat resistance. Examples of the filler components include the following:

- Silica, alumina, iron oxide, titanium oxide, cerium oxide, cerium hydroxide and carbon black.

Such an addition-curable silicone rubber adhesive is also commercially available and can be easily obtained.

It is preferable that the thickness of the adhesive layer be 20 μm or smaller. Due to the thickness being set at 20 μm or smaller, the thermal resistance of the fixing member can be set small, and the heat from the inner surface side (base body side) can be efficiently transmitted to a recording material such as an unfixed toner and paper.

(5) Surface Layer of Fixing Member

The surface layer 6 is formed of a fluororesin, and a tube method or a coating method is employed as a forming method. Examples of the tube method will be described below, which is a method of covering with such an article that a resin of which the examples are described below is formed into a tube shape.

- Tetrafluoroethylene-perfluoro (alkyl vinyl ether) copolymer (PFA), polytetrafluoroethylene (PTFE), tetrafluoroethylene-hexafluoropropylene copolymer (FEP), and the like. Among the resin materials listed above, PFA is preferable from the viewpoint of being excellent in formability and/or toner releasability.

It is preferable that the thickness of the fluororesin layer (surface layer) be set at 10 μm or larger and 50 μm or smaller. This is because when the fluororesin layer has been laminated on the elastic layer, the elasticity of the elastic layer of the lower layer can be maintained, and its abrasion resistance can be secured while suppressing that the surface hardness of the fixing member becomes too high.

The inner surface of the fluororesin tube is subjected to sodium treatment, excimer laser treatment, ammonia treatment or the like in advance, and thereby its adhesiveness can be improved.

Figure 8:
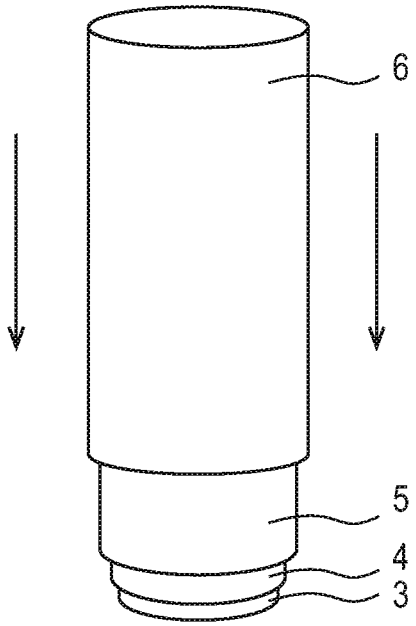
FIG. 8 illustrates a schematic view of one example of a step of laminating a surface layer.

FIG. 8 is a schematic view for explaining one example of a step of laminating the surface layer 6 on the elastic layer 4 that contains silicone rubber, via an addition-curable silicone rubber adhesive. The addition-curable silicone rubber adhesive is applied to the surface of the elastic layer 4 formed on the outer circumferential surface of the base body 3. Furthermore, the outer surface of the elastic layer 4 is covered with a fluororesin tube 6, which is the surface layer 6, and is laminated.

A method for covering the elastic layer 4 with the fluororesin tube is not limited in particular, but a method of covering by the use of an addition-curable type silicone rubber adhesive as a lubricant, or a method of covering by expanding the fluororesin tube from the outside, and the like can be used.

An excess addition-curable type silicone rubber adhesive that has remained between the elastic layer 4 and the surface layer 6 formed of the fluororesin is removed by being threshed, by the use of an unillustrated unit. It is preferable that the thickness of the adhesive layer 5 after the threshing be 20 μm or smaller, from the viewpoint of suppressing a decrease in the thermal conductivity. Next, the addition-curable silicone rubber adhesive is cured and is bonded by being heated for a predetermined time period in a heating unit such as an electric furnace, and both ends in the width direction are cut to a desired length; and thereby the fixing member can be obtained.

(6) Heat Fixing Apparatus

The heat fixing apparatus according to the present embodiment is structured so that rotating bodies such as a pair of a heated roller and a roller, a belt and a roller, and a belt and a belt are pressed against each other. The type of the heat fixing apparatus is appropriately selected in consideration of conditions such as a process speed and a size of the whole image forming apparatus on which the heat fixing apparatus is mounted.

In the heat fixing apparatus, a heated fixing member and a pressing member are pressed against each other to form a fixing nip N, and a recording medium S that is a body to be heated and has an image formed thereon by an unfixed toner is sandwiched and conveyed by the fixing nip N. The image formed by the unfixed toner is referred to as a toner image t. Thereby, the toner image t is heated and pressed. As a result, the toner image t is melted, and colors are mixed. After that, the toner image is cooled, and is fixed on the recording medium.

(7) Image Forming Apparatus

The image forming apparatus according to the present embodiment includes:

- a photosensitive member,
- a charging apparatus that charges the photosensitive member;
- an exposure apparatus that forms an electrostatic latent image by exposing the charged photosensitive member to light, a developing apparatus that develops the electrostatic latent image formed on the photosensitive member with a toner to form a toner image;

a transfer apparatus that transfers the toner image formed on the photosensitive member to a recording medium; and the above heat fixing apparatus.

The configuration of the heat fixing apparatus will be described below with reference to specific examples, but the scope and application of the present disclosure are not limited thereto.

(6-1) Fixing Belt-Pressing Belt Type of Heat Fixing Apparatus

Figure 9:
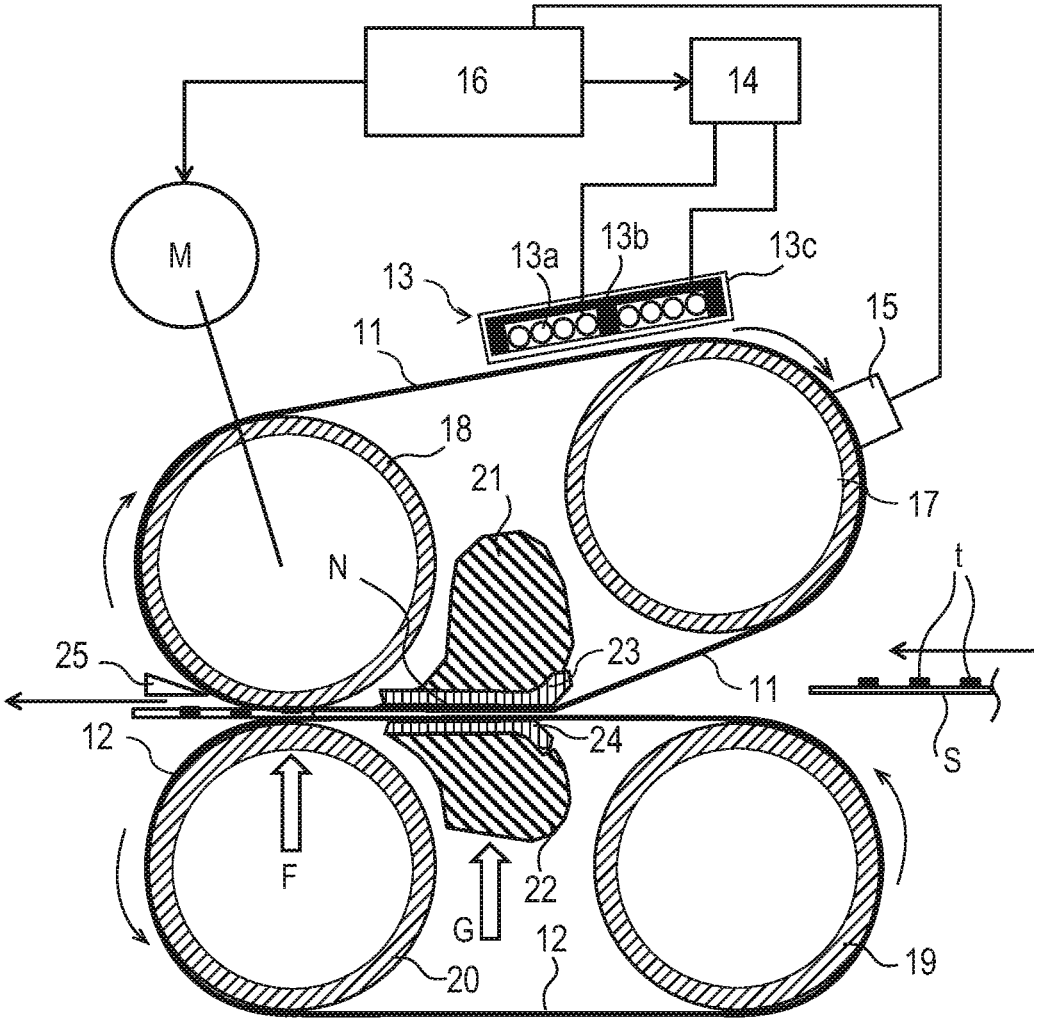
FIG. 9 illustrates a schematic cross-sectional view illustrating one example of a heat fixing apparatus in which a fixing-belt and a pressing-belt are employed.

FIG. 9 illustrates a so-called twin belt type of heat fixing apparatus in which rotating bodies such as a pair of a fixing belt 11 and a pressing belt 12 are pressed against each other; and is a schematic cross-sectional view of one example of the heat fixing apparatus including the fixing belt as a fixing member.

Here, the width direction of the heat fixing apparatus or members constituting the heat fixing apparatus is a direction perpendicular to the paper surface of FIG. 9. The front face of the heat fixing apparatus is a face of the introduction side (right side in FIG. 9) of the recording medium S. The left or right of the heat fixing apparatus is the left or right when viewing the heat fixing apparatus from the front face. The width of the belt is a dimension of the belt in the left-right direction when viewing the heat fixing apparatus from the front face. In addition, the width of the recording medium S is a dimension of the recording medium in a direction orthogonal to the conveyance direction. In addition, an upper stream or lower stream means the upper stream (right side in FIG. 9) or the lower stream (left side in FIG. 9) with respect to the conveyance direction of the recording medium.

This heat fixing apparatus includes a fixing belt 11 as a fixing member, and a pressing belt 12. The fixing belt 11 and the pressing belt 12 are belts that each includes a base body made of a metal containing nickel as a main component, and has flexibility, as illustrated in FIG. 4A, and are each stretched around the two rollers.

A heating unit for heating the fixing belt 11 adopts a heating source (induction heating member, excitation coil) that can heat the fixing belt by the electromagnetic induction heating, which is high in energy efficiency. The induction heating member 13 includes an induction coil 13*a*, an excitation core 13*b*, and a coil holder 13*c* that holds the coils and the core. An elliptically and flatly wound litz wire is used for the induction coil 13*a*, and the induction coil 13*a* is arranged in a horizontal E-shaped excitation core 13*b* that has protrusions in the center and both sides of the induction coils. For the excitation core 13*b*, a material such as ferrite and permalloy, which have high magnetic permeability and low residual magnetic flux density, is employed, thereby suppressing a loss due to the induction coil 13*a* and/or the excitation core 13*b*, and accordingly, the excitation core 13*b* can efficiently heat the fixing belt 11.

When a high-frequency current flows from an excitation circuit 14 to the induction coil 13*a* of the induction heating member 13, the base body of the fixing belt 11 is induced to generate heat, and the fixing belt 11 is heated from the base body side. The surface temperature of the fixing belt 11 is detected by a temperature detecting element 15 such as a thermistor. A signal relating to the temperature of the fixing belt 11, which is detected by the temperature detecting element 15, is sent to a control circuit section 16. The control circuit section 16 controls an electric power supplied from the excitation circuit 14 to the induction coil 13*a* based on the temperature information from the temperature detecting element 15 so as to maintain the temperature of the fixing belt at a predetermined temperature.

The fixing belt 11 is stretched around a roller 17 and a heating-side roller 18, which function as a belt rotating member. The roller 17 and the heating-side roller 18 are each rotatably supported by bearing between unillustrated left and right side plates of the apparatus.

The roller 17 is, for example, a hollow roller made of iron, of which the outer diameter is 20 mm, the inner diameter is 18 mm and the thickness is 1 mm, and functions as a tension roller that applies tension to the fixing belt 11. The heating-side roller 18 is, for example, such a highly slidable elastic roller that a silicone rubber layer is provided as an elastic layer, on a core metal made of an iron alloy, of which the outer diameter is 20 mm, the inner diameter is 18 mm and the thickness is 1 mm.

To the heating-side roller 18, as a driving roller, a driving force is input from a driving source (motor) M via an unillustrated driving gear train, and the heating-side roller is driven so as to rotate in a clockwise direction as indicated by an arrow at a predetermined speed. Due to the elastic layer being provided on the heating-side roller 18 as described above, the heating-side roller 18 can transmit the driving force input thereto satisfactorily to the fixing belt 11, and can form a fixing nip for securing separativeness of the recording medium from the fixing belt 11. Due to the heating-side roller 18 having the elastic layer, the heat conduction to the heating-side roller is reduced, which is effective also in shortening the warm-up time.

When the heating-side roller 18 is rotationally driven, the fixing belt 11 rotates together with the roller 17, due to a frictional force generated between the silicone rubber surface of the heating-side roller 18 and the inner surface of the fixing belt 11. The arrangement and the sizes of the roller 17 and the heating-side roller 18 are selected according to the size of the fixing belt 11. For example, the dimensions of the above roller 17 and heating-side roller 18 are selected so as to be capable of stretching the fixing belt 11 of which the inner diameter is 55 mm at the time when the fixing belt is not mounted.

The pressing belt 12 is stretched around a tension roller 19 and a pressing-side roller 20, which each function as a belt rotating member. The inner diameter of the pressing belt when not mounted is, for example, 55 mm. The tension roller 19 and the pressure-side roller 20 are each rotatably supported by bearing between unillustrated left and right side plates of the apparatus.

The tension roller 19 has a silicone sponge layer provided on a core metal made of an iron alloy, of which the outer diameter is 20 mm, the inner diameter is 16 mm and the thickness is 2 mm, in order to decrease the coefficient of thermal conductivity and reduce the heat conduction from the pressing belt 12.

The pressing-side roller 20 is, for example, a rigid roller that is made of an iron alloy and has low slidability, and of which the outer diameter is 20 mm, the inner diameter is 16 mm and the thickness is 2 mm. The dimensions of the tension roller 19 and the pressing-side roller 20 are selected according to the dimension of the pressing belt 12, in the same manner. Here, an unillustrated pressing mechanism presses the left and right end sides of the rotation shaft of the pressing-side roller 20 toward the heating-side roller 18 with a predetermined pressing force in the direction of an arrow F, so as to form the nip portion N between the fixing belt 11 and the pressing belt 12.

In addition, a pressing pad is adopted so as to obtain a wide nip part N without upsizing the apparatus. Specifically, the pressing pads are a fixing pad 21, which functions as a first pressing pad for pressing the fixing belt 11 toward the pressing belt 12, and a pressing pad 22, which functions as a second pressing pad for pressing the pressing belt 12 toward the fixing belt 11. The fixing pad 21 and the pressing pad 22 are each arranged so as to be supported between the unillustrated left and right side plates of the apparatus. The pressing pad 22 is pressed toward the fixing pad 21 with a predetermined pressing force in the direction of an arrow G, by an unillustrated pressing mechanism. The fixing pad 21 that is the first pressing pad has a sliding sheet (low friction sheet) 23, which comes in contact with a base body of its pad and a belt. The pressing pad 22 that is the second pressing pad also has a sliding sheet 24, which comes in contact with a base body of its pad and a belt. This is to suppress the scraping in the portion of the pad, that rubs against the inner circumferential surface of the belt. The sliding sheets 23 and 24 are interposed each between the belt and the base body of the pad, thereby suppress the scraping of the pad, and can also reduce sliding resistance; and accordingly satisfactory running performance and durability of the belt can be secured.

Note that a non-contact type of static elimination brush (unillustrated) and a contact type of static elimination brush (unillustrated) are provided for the fixing belt 11 and the pressing belt 12, respectively.

The control circuit section 16 drives a motor M at least when image formation is carried out. Thereby, the heating-side roller 18 is rotationally driven, and the fixing belt 11 is rotationally driven in the same direction. The pressing belt 12 rotates by being driven by the fixing belt 11. Here, the apparatus is configured so that a heating-side roller 18 and a pressing-side roller 20 sandwiches the fixing belt 11 and the pressing belt 12 at a portion on the most downstream side of the fixing nip, and thereby the slip of the fixing belt can be suppressed. The portion on the most downstream side of the fixing nip is a portion at which a pressure distribution (conveyance direction of recording medium) in the fixing nip becomes maximum.

The recording medium S having the unfixed toner image t thereon is conveyed to the nip portion N between the fixing belt 11 and the pressing belt 12, in a state in which a temperature of the fixing belt 11 has risen to a predetermined fixing temperature and is maintained (hereinafter, referred to as temperature control). The recording medium S is introduced in such a way that the surface carrying the unfixed toner image t thereon faces the fixing belt 11 side. Then, the unfixed toner image t of the recording medium S is sandwiched and conveyed while being brought in close contact with the outer circumferential surface of the fixing belt 11, thereby heat is given from the fixing belt 11; and by receiving the pressing force, the toner image is fixed to the surface of the recording medium S. At this time, the heat transmitted from the heated base body of the fixing belt 11 is efficiently conveyed toward the recording medium S through the elastic layer of which the thermal conductivity in the thickness direction is enhanced. After that, the recording medium S is separated from the fixing belt 11 by a separating member 25, and is conveyed.

(6-2) Fixing Belt-Pressing Roller Type of Heat Fixing Apparatus

Figure 10:
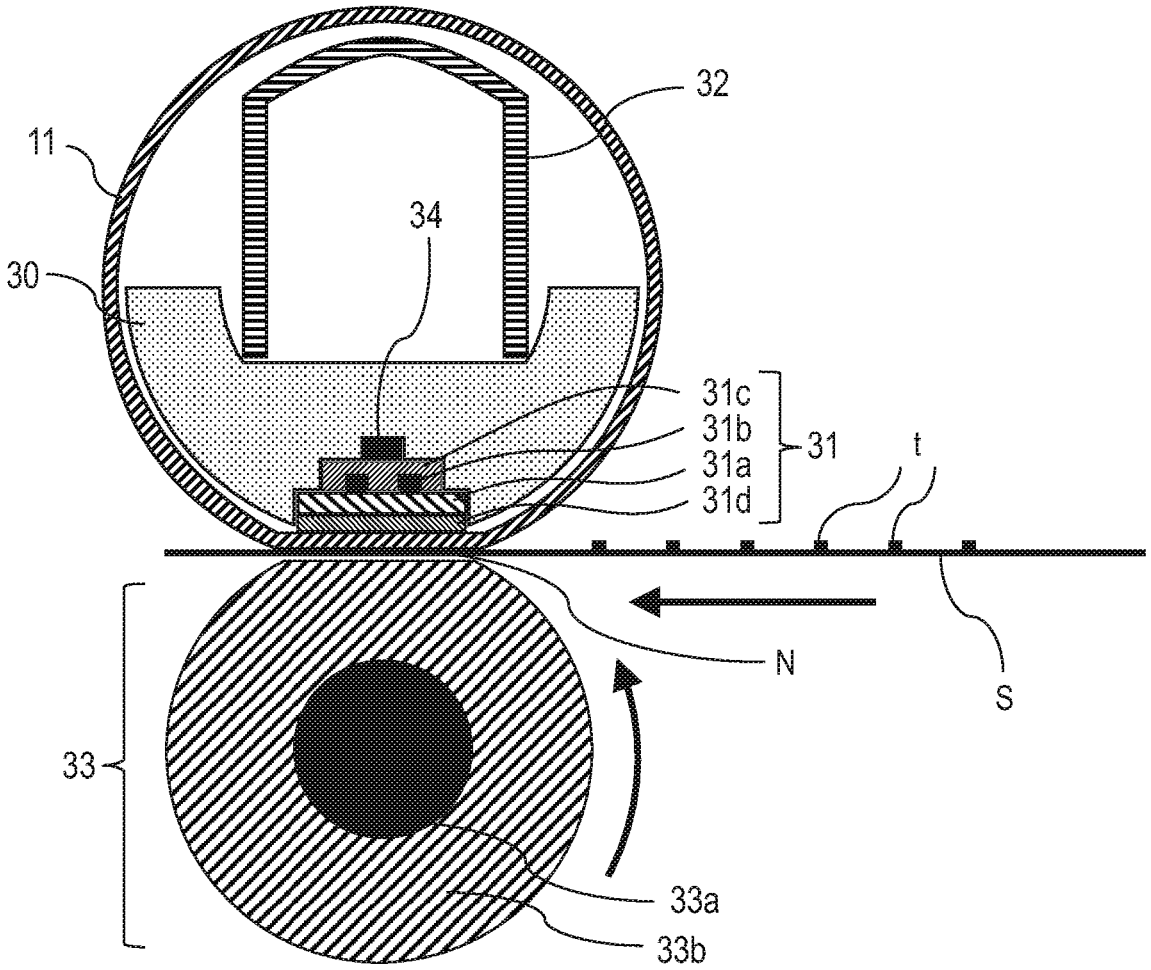
FIG. 10 illustrates a schematic cross-sectional view illustrating one example of a fixing-belt pressing-roller type of heat fixing apparatus.

FIG. 10 illustrates a schematic view illustrating an example of a heating belt-pressing roller type of heat fixing apparatus according to one aspect of the present disclosure, which has a fixing member for electrophotography having an endless shape, which specifically includes: a fixing belt 11; a pressing roller 33; and a ceramic heater 31 that is a heating body for heating the fixing belt by non-radiant heating, which is arranged in the inner part of the fixing belt 11. Note that in the heat fixing apparatus according to the present disclosure, the heater for heating the fixing belt is not limited to the heater for heating the fixing belt with the non-radiant heating, which is described in the present aspect. For example, such a heater can also be used as a halogen heater, which can heat the fixing belt by radiation heat.

In FIG. 10, the belt as described above is used as the fixing belt 11 having a cylindrical shape or an endless shape. The fixing belt 11 is held by a heat-resistant and heat-insulating belt guide 30. The ceramic heater 31 for heating the fixing belt 11 is fitted into a groove formed and provided along the longitudinal direction of the guide (direction perpendicular to paper surface), at a position at which the belt guide 30 comes in contact with the fixing belt 11 (approximately in the center of the lower surface of the belt guide 30), and is fixedly supported. In addition, the fixing belt 11 is loosely fitted around the belt guide 30. The rigid stay 32 for pressing is inserted into the inside of the belt guide 30.

On the other hand, a pressing roller 33 is arranged that opposes to the fixing belt 11. In the present example, the pressing roller 33 is an elastic pressing roller, that is, specifically a pressing roller in which an elastic layer **33*b* of silicone rubber is provided around a core metal 33*a* to reduce the hardness. The pressing roller 33 is arranged in such a way that both ends of the core metal 33*a*** are rotatably supported by bearing and held between a chassis side plate (unillustrated) on the front side of the apparatus and a chassis side plate (unillustrated) on the back side of the apparatus. In addition, the elastic pressing roller is covered with an unillustrated PFA (tetrafluoroethylene/perfluoroalkylether copolymer) tube, in order to improve the surface properties.

The pressing springs (unillustrated) are each provided in a compressed state between both ends of the rigid stay 32 for pressing and spring receiving members (unillustrated) on the apparatus chassis side, and exert a depressing force on the rigid stay 32 for pressing. Thereby, a lower surface of the ceramic heater 31 that is arranged on the lower surface of the belt guide 30 made of a heat resistant resin and an upper surface of the pressing roller 33 are brought into pressure contact with each other so as to sandwich the fixing belt 11, and form a fixing nip part N.

The pressing roller 33 is rotationally driven by an unillustrated driving unit, in a counterclockwise direction indicated by an arrow. A frictional force works between the pressing roller 33 and the outer surface of the fixing belt 11 due to the rotational driving of the pressing roller 33, and thereby a rotational force acts on the fixing belt 11. Then, the inner circumferential surface of the fixing belt 11 is brought into contact with the lower surface of the ceramic heater 31 in the fixing nip part N, and while sliding, the fixing belt rotates around the belt guide 30 at a circumferential speed almost corresponding to the rotational circumferential speed of the pressing roller 33, in a clockwise direction.

(Drive System of Pressing Roller)

According to the print start signal, the rotation of the pressing roller 33 is started, and the heat-up of the ceramic heater 31 is started. At the moment when the rotational circumferential speed of the fixing belt 11 caused by the rotation of the pressing roller 33 becomes steady, and a temperature of the temperature detecting element 34 provided on the upper surface of the ceramic heater has risen to a predetermined temperature, the recording medium S is introduced into the fixing nip part N between the fixing belt 11 and the pressing roller 33, and is heated. The predetermined temperature is, for example, 180° C. The recording medium S that is a material to be heated and carries an unfixed toner image t thereon is introduced in such a way that the surface side that carries the toner image thereon faces the fixing belt 11 side. Then, in the fixing nip part N, the recording medium S comes in close contact with the lower surface of the ceramic heater 31 via the fixing belt 11, and moves and passes through the fixing nip part N together with the fixing belt 11. In a process in which the recording medium moves and passes, the heat of the fixing belt 11 is imparted to the recording medium S, and the toner image t is heated and fixed on the surface of the recording medium S. The recording medium S that has passed through the fixing nip part N is separated from the outer surface of the fixing belt 11, and is conveyed.

The ceramic heater 31 as a heating body, is a linear shaped heating body having a low heat capacity, and elongating in a direction orthogonal to a movement direction of the fixing belt 11 and the recording medium S. The ceramic heater 31 has preferably a basic structure of a heater substrate 31*a* made of aluminum nitride or the like; a heat generating layer 31*b* that is provided on the surface of the heater substrate 31*a* along the longitudinal direction thereof; and a protective layer 31*c* that is provided further thereon and is made of glass, fluororesin or the like. The heat generating layer 31*b* is preferably a layer that has been formed so that the thickness is approximately 10 μm and the width is 1 to 5 mm, by an application of an electric resistance material such as Ag/Pd (silver/palladium) by screen printing or the like. Note that the ceramic heater to be used is not limited to such a ceramic heater.

Then, an electric current is supplied between both ends of the heat generating layer 31*b* of the ceramic heater 31, thereby the heat generating layer 31*b* generates heat, and the temperature of the ceramic heater 31 rapidly rises.

The ceramic heater 31 is fitted into a groove formed and provided substantially in the center of the lower surface of the belt guide 30 along the longitudinal direction of the guide, in such a way that the protection layer 31*c* side directs upward, and is thereby fixedly supported. In the fixing nip part N in which a sliding member 31*d* is provided on the lower surface of the heater substrate 31*a* and comes into contact with the fixing belt 11, it is preferable that the lower surface of the sliding member 31*d* and the inner surface of the fixing belt 11 be brought into contact with each other and are slid.

As described above, in the fixing belt 11, the coefficient of thermal conductivity in the thickness direction of the elastic layer containing the silicone rubber is enhanced and the hardness is suppressed to be low. Due to such a structure, the fixing belt 11 can efficiently heat the unfixed toner image; and because of having low hardness, can fix a high-quality image on the recording medium S.

As described above, according to one aspect of the present disclosure, there is provided a heat fixing apparatus having the above fixing member arranged. Accordingly, the heat fixing apparatus can be provided in which the fixing member is arranged that is excellent in the fixing performance and can fix a high-quality image.

As described above, according to one aspect of the present disclosure, there is provided a fixing member having the elastic layer that is high in the thermal conductivity in the thickness direction, resists causing the fracture or the plastic deformation even by the repeated compression in a high temperature state, and is low in the hardness. According to another aspect of the present disclosure, there is provided a heat fixing apparatus and an image forming apparatus that are excellent in fixing properties, can form a high-quality electrophotographic image, and are excellent in paper passing durability.

EXAMPLES

The present disclosure will be described in more detail below with reference to Examples.

[Comparison Test of Hardness Unevenness]

The hardness unevenness was compared between an elastic layer sample produced with the use of parallel plate electrodes and an elastic layer sample produced with the use of a corona charger according to Example of the present disclosure.

(1) Preparation of Liquid Addition-Curable Type Silicone Rubber Composition

Firstly, as component a, 98.6 parts by mass of the silicone rubber was prepared that had a vinyl group that was an unsaturated aliphatic group, only at both ends of the molecular chain, and in addition, had a methyl group as an unsubstituted hydrocarbon group that did not contain an unsaturated aliphatic group. This silicone rubber (trade name: DMS-V35, manufactured by Gelest Inc., viscosity of 5,000 $mm^2/s$) is hereinafter referred to as "Vi".

Next, 220 parts by mass of spherical alumina (trade name: CB-P10, manufactured by Showa Denko K.K.) was added to this Vi, as a thermally-conductive filler. Furthermore, 120 parts by mass of amorphous alumina (trade name: LS-130, manufactured by Nippon Light Metal Company, Ltd.) was added thereto, the resultant mixture was sufficiently mixed to obtain mixture 1. Next, 0.2 parts by mass of 1-ethynyl-1-cyclohexanol (manufactured by Tokyo Chemical Industry Co., Ltd.), which was a cure retarder and was defined as component d was dissolved in the same mass of toluene, and the resultant solution was added to the mixture 1 to obtain mixture 2.

Next, 0.1 parts by mass of a hydrosilylation catalyst (mixture of: platinum catalyst, which is 1,3-divinyltetramethyldisiloxane platinum complex; 1,3-divinyltetramethyldisiloxane; and 2-propanol) was added to the mixture 2 as component (c) to obtain mixture 3.

Furthermore, 1.4 parts by mass of the silicone rubber (trade name: HMS-301, manufactured by Gelest Inc., viscosity of 30 $mm^2/s$, hereinafter, referred to as "SiH") was measured as component b, which had a straight-chain siloxane skeleton and had an active hydrogen group bonded to silicon only on a side-chain. This silicone rubber was added to the mixture 3, the resultant mixture was sufficiently mixed to obtain a liquid addition-curable type silicone rubber composition.

(2-1) Production of Parallel Plate Electrode Sample

The above silicone rubber composition was sandwiched between an acrylic spacer having a thickness of 500 μm and glass electrodes of an indium tin oxide (hereinafter, referred to as "ITO"), and a sample piece was produced that had a square shape of which the length of one side was 50 mm and the thickness was 500 μm.

A power supply was connected to the ITO glass electrodes, and while an AC voltage of 950 V having a frequency of 60 Hz was applied to the ITO glass electrodes, the silicone rubber was left at rest for 2 hours in an environment of a temperature of 80° C., and the silicone rubber was cured. After that, the cured product of the silicone rubber was peeled off from the electrodes, and was left at rest for 30 minutes in an environment at a temperature of 200° C., was thereby secondarily cured to obtain a parallel plate electrode sample.

(2-2) Production of Corona Charged Sample

An uncured film of the above silicone rubber composition having a thickness of 500 μm was formed on a film of a stainless-steel (hereinafter referred to as "SUS film"), with the use of a slit coater. The SUS film was affixed to a cylindrical core, and was subjected to charging treatment by a corona charger while the cylindrical core was rotated. As for the conditions, a rotation speed was 100 rpm, a supply current to the wire of the corona charger was −150 μA, a grid electrode potential was −950 V, a charging time period was 20 seconds, and a distance between the grid electrode and the uncured film was 4 mm.

Thus charged uncured sample was heated in an electric furnace at 160° C. for 1 minute (primary curing), and was then heated in an electric furnace at 200° C. for 30 minutes (secondary curing); and thereby the silicone rubber composition was cured to obtain a corona charged sample.

(3) Evaluation of Hardness Unevenness of Sample

Each of the obtained samples was adjusted so as to be a square shape of which the length of one side was 50 mm, the rubber hardness of 10 portions in the plane were measured with a micro rubber hardness meter (MD-1 TYPE-C hardness meter, manufactured by Kobunshi Keiki Co., Ltd.), and an average value of the rubber hardness and its standard deviation were calculated.

The results were as follows.

Corona charged sample: the average value of the rubber hardness was 64.1°, and the standard deviation was 1.7°.

Parallel plate electrode sample: the average value of the rubber hardness was 65.5°, and the standard deviation was 7.3°.

It was found that the parallel plate electrode sample had large hardness unevenness and was difficult to apply to a fixing member.

Example 1

(1) Preparation of Liquid Addition-Curable Type Silicone Rubber Composition

A liquid addition-curable type silicone rubber composition was obtained in the same manner as in the comparison test of the hardness unevenness.

(2) Production of Fixing Belt

An endless belt made of electroformed nickel was prepared as a base body, of which the inner diameter was 55 mm, the width was 420 mm, and the thickness was 65 μm. Note that in a series of manufacturing steps, the endless belt was handled in such a way that a core was inserted in its inner part.

A primer (trade name: DY39-051A/B; manufactured by Dow Corning Toray Co., Ltd.) was applied substantially uniformly to the outer circumferential surface of the base body so that the dry mass was 50 mg, and after the solvent was dried, the resultant primer was subjected to baking treatment in an electric furnace set at 160° C., for 30 minutes.

The above silicone rubber composition was applied onto the primer-treated base body by a ring coat method so that the thickness was 450 μm. This is referred to as an uncured endless belt.

Next, the corona charger was oppositely arranged along the generatrix of the uncured endless belt, and while the uncured endless belt was rotated at 100 rpm, the surface of the elastic layer was charged before being cured. As for the conditions, the supply current to the discharge wire of the corona charger was set at −150 μA, the grid electrode potential was set at −950 V, the charging time period was set at 20 seconds, and the distance between the grid electrode and the belt was set at 4 mm.

This charged uncured endless belt was heated in an electric furnace at 160° C. for 1 minute (primary curing), and was then heated in an electric furnace at 200° C. for 30 minutes (secondary curing); and thereby the silicone rubber composition was cured to obtain a cured endless belt provided with an elastic layer.

Next, onto the surface of the elastic layer of the cured endless belt, an addition-curable silicone rubber adhesive (trade name: SE1819CV A/B, manufactured by Dow Corning Toray Co., Ltd.) was substantially uniformly applied as an adhesive layer so that the thickness was approximately 20 μm. On the adhesive, a fluororesin tube (trade name: NSE, manufactured by Gunze Limited) of which the inner diameter was 52 mm and the thickness was 40 μm was laminated as a mold releasing layer, while the diameter was expanded. After that, the belt surface was uniformly squeezed from above the fluororesin tube, thereby excess adhesive was threshed from between the elastic layer and the fluororesin tube to reduce the thickness of the adhesive layer to approximately 5 μm.

This endless belt was heated in an electric furnace set at 200° C. for 1 hour, thereby the adhesive was cured, and the fluororesin tube was fixed on the elastic layer. Both ends of the obtained endless belt were cut to obtain a fixing belt having the width of 368 mm (3) Characteristic Evaluation of Elastic Layer of Fixing Belt (3-1) Evaluation of Area Proportion and Orientation of Filler, in Cross Section in Thickness Direction of Elastic Layer From the elastic layer of the produced fixing belt, 10 spots in total of 5 spots from the first cross-section in the thickness-circumferential direction and 5 spots from the second cross-section in the thickness-axial direction were cut each to a size of 5 mm×5 mm, and the observational cross-section was formed by an ion beam. A cross-section polisher (trade name: SM09010; manufactured by JEOL Ltd.) was used for forming the cross section, the applied voltage was set at 4.5 V, and in an argon gas atmosphere, the fixing belt was irradiated with an ion beam from the base body side toward the thickness direction for 11 hours to produce the observational cross-section.

The reason why the fixing belt was irradiated with the ion beam from the base body side toward the thickness direction of the fixing belt is because if the fixing belt was irradiated from the surface side, residues of a shaved fluororesin on the surface layer would attach to the surface. The obtained observational cross-section was observed with a laser microscope (trade name: OLS3000, manufactured by Olympus Corporation) with the use of an objective lens of 50 magnifications to obtain a cross-sectional image with a size of 150 μm×100 μm.

Subsequently, the cross-sectional image was subjected to binarization processing by image processing software Image J (manufactured by the National Institutes of Health). The Otsu method was employed as the binarization method.

From the obtained binarized image, it was found that an area proportion A of the first filler having a major axis/minor axis of smaller than 1.5 was 0.30, and an area proportion B of the second filler having a major axis/minor axis of 1.5 or larger was 0.16.

Next, the average orientation angle $\theta_{Ave}$ of the second fillers having a major axis/minor axis of 1.5 or larger was calculated by image processing, and as a result, the average orientation angle $\theta_{Ave}$ was 60°.

(3-2) Coefficient of Thermal Conductivity of Elastic Layer in Thickness Direction A coefficient of thermal conductivity λ of the elastic layer in the thickness direction was calculated from the following expression.

$$\lambda=\alpha\times C_p\times\rho$$

In the expression, λ is the coefficient of thermal conductivity of the elastic layer in the thickness direction (W/(m·K)), α is a coefficient of thermal diffusivity in the thickness direction ($m^2/s$), $C_p$ is specific heat at constant pressure (J/(kg·K))), and ρ is density ($kg/m^3$). Here, the values of the coefficient of thermal diffusivity α in the thickness direction, the specific heat at constant pressure $C_p$, and the density ρ were determined by the following methods.

Coefficient of Thermal Diffusivity α

The coefficient of thermal diffusivity α of the elastic layer in the thickness direction was measured at room temperature (25° C.) with the use of a periodic heating method thermophysical property measuring apparatus (trade name: FTC-1, manufactured by Advance Riko, Inc.). A sample piece having an area of 8 mm×12 mm was cut out from the elastic layer with a cutter, and thus five sample pieces in total were produced; and the thickness of each sample piece was measured with the use of a digital end measuring machine (trade name: DIGIMICRO (registered trademark) MF-501 flat probe ϕ4 mm; manufactured by Nikon Corporation). Next, each sample piece was measured five times in total, and the average value ($m^2/s$) was determined. The sample piece was subjected to the measurement while being pressed with the use of a weight of 1 kg.

As a result, the coefficient of thermal diffusivity α of the elastic layer of the silicone rubber in the thickness direction was $6.33\times10^{-7}$ $m^2/s$.

Specific Heat at Constant Pressure $C_p$

The specific heat at constant pressure of the elastic layer was measured with the use of a differential scanning calorimeter (trade name: DSC823e, manufactured by Mettler-Toledo International Inc.).

Specifically, aluminum pans were used as a pan for a sample and a pan for reference. Firstly, as blank measurement, the measurement was performed according to a program of keeping both the pans in an empty state, at a constant temperature of 15° C. for 10 minutes, then heating the pans to 215° C. at a rate of temperature rise of 10° C./min, and keeping the pans at a constant temperature of 215° C. for further 10 minutes. Next, 10 mg of synthetic sapphire of which the specific heat at constant pressure was known was used as a reference substance, and the measurement was performed according to the same program.

Next, 10 mg of the measurement sample, which was the same amount as that of the synthetic sapphire of the reference substance, was cut out from the elastic layer, then was set in a sample pan, and was subjected to the measurement according to the same program. These measurement results were analyzed with the use of specific heat analyzing software that was attached to the above differential scanning calorimeter, and the specific heat at constant pressure $C_p$ at 25° C. was calculated from the average value of the five measurement results.

As a result, the specific heat at constant pressure of the elastic layer of the silicone rubber was 0.94 J/(g·K).

Density ρ

The density of the elastic layer was measured with the use of a dry-type automatic densitometer (trade name: AccuPyc 1330-01, manufactured by Shimadzu Corporation).

Specifically, a sample cell of 10 $cm^3$ was used; and a sample piece was cut out from the elastic layer so as to satisfy approximately 80% of the cell volume, the mass of the sample piece was measured, and then the sample piece was charged into the sample cell. This sample cell was set in a measurement part in the apparatus; helium was used as a gas for measurement, and the gas was purged; and then the volume was measured ten times. The density of the elastic layer was calculated from the mass of the sample piece and the measured volume, for each time, to determine the average value.

As a result, the density of the elastic layer of the silicone rubber was 2.35 $g/cm^3$.

The coefficient of thermal conductivity λ of the elastic layer in the thickness direction was calculated from the specific heat at constant pressure $C_p$ (J/(kg·K)) and the density ρ (kg/m 3) of the elastic layer, of which the units were converted, and from the measured coefficient of thermal diffusivity c ($m^2/s$); and as a result, the coefficient of thermal conductivity λ was 1.40 W/(m·K).

(3-3) Tensile Modulus of Elasticity of Elastic Layer

In order to confirm that the hardness of the elastic layer was low, the tensile modulus of elasticity of the elastic layer was measured. Specifically, a sample piece was cut out from the elastic layer by a punching die (dumbbell shape No. 8 type, which is specified in JIS K6251:2004), and the thickness in the vicinity of the center was measured, which was a spot to be measured. Next, the cut-out sample piece was tested at a room temperature, at a tensile speed of 200 mm/min with the use of a tensile tester (apparatus name: Strograph EII-L1, manufactured by Toyo Seiki Seisaku-sho, Ltd.). Note that the tensile modulus of elasticity was determined to be an inclination at the time when a graph was created in which the strain of the sample piece was taken on the horizontal axis and the tensile stress was taken on the vertical axis, from the measurement results, and the measured data was linearly approximated in such a range that the strain was 0 to 10%.

As a result, the tensile modulus of elasticity of the elastic layer was 0.63 MPa.

(4) Evaluation of High-Temperature Pressure Resistance of Elastic Layer of Fixing Belt From the obtained fixing belt, four sample pieces each having a size of 50 mm×50 mm, were cut out. Each of the sample pieces was supported on a stainless steel plate (hereinafter referred to as "SUS plate") 40 (FIG. 11), and four test pieces were prepared.

Figure 11:
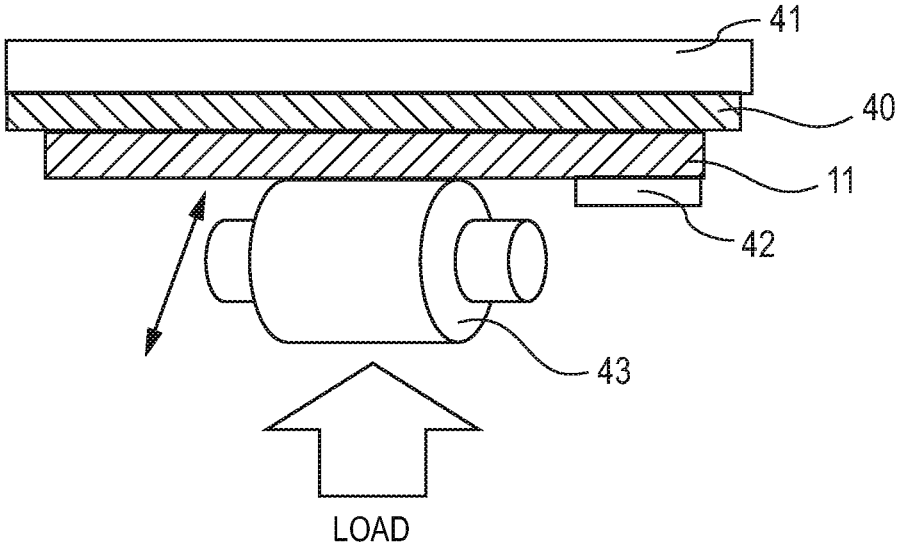
FIG. 11 illustrates a schematic view relating to a high-temperature pressure-resistance test.

The high-temperature pressure resistance was evaluated by using the four test pieces, with a jig illustrated in FIG. 11. The jig was structured so as to be capable of evaluating the high-temperature pressure resistance by relatively reciprocating a pressing roller 43 (width of 10 mm and diameter of 15 mm) to right and left, in such a state that the surface temperature of each of the test pieces (the fixing belt 11) is set at a high temperature by the heater 41 and the thermistor 42. In this evaluation, the pressing roller 43 was relatively reciprocated to right and left with a load of 15 N on a surface of each of the sample pieces on the SUS plate, while the surface of the sample pieces were maintained at the temperature of 240° C., and an average value of the time periods until each of the sample pieces on the SUS plate caused the fracture or plastic deformation. Here, in the case that any fracture or plastic deformation was not observed in the sample piece when 10 hours was elapsed from the start of the testing, the durability of the test sample was evaluated as good, and the test was finished. The fixing member as so evaluated was shown as "10 hours (Good)" in the Table 2.

As a result, in the present Example, even after a lapse of 10 hours, the fracture or plastic deformation of the rubber did not occur, and the durability was satisfactory.

(5) Actual Machine Evaluation (Fixing Property, Image Quality and Durability)

The fixing belt obtained as in the above way was incorporated in a heat fixing apparatus of an electrophotographic copying machine (trade name: imagePRESS (registered trademark) C850, manufactured by Canon Inc.).

With the use of a copying machine equipped with this heat fixing apparatus, a fixing property onto thick paper was tested. In addition, the fixing property and the image quality were evaluated, and paper passing durability was tested with the use of plain paper.

For the test of the fixing property on the thick paper, a paper of which the basis weight was 300 g/m$^2$ (UPM Finesse (registered trademark) gloss 300 g/m$^2$, manufactured by UPM Paper Company) was used. Then, the temperature was lowered than the standard temperature control (195° C.), five blue solid images were continuously passed, and the fixing ability were evaluated according to whether or not the toner was fixed on the paper.

As a result, the toner was fixed on the paper even at a temperature control of 185° C., which was 10° C. lower than the standard, and it was found that the thermal conductivity of the elastic layer of the fixing belt was extremely excellent.

In addition, the image quality was visually evaluated, from the viewpoint of whether or not gloss unevenness occurred in the image. As a result, there was not the gloss unevenness, and the image quality was extremely excellent, which originated in that the hardness of the elastic layer was low and there was not hardness unevenness. If the hardness of the elastic layer was high or there was hardness unevenness, the followability to the irregularities of the paper fiber would be impaired, and the gloss unevenness would occur; but such gloss unevenness did not occur.

In the paper passing durability test, a color laser copier paper of high-quality paper of 80 g/m$^2$ (manufactured by Canon Inc.) with a size of A4 was continuously conveyed in the transverse direction and fed (80 sheets/min). In addition, a uniform image of halftone with a cyan color was formed on the coated paper of OK top coat of 128 g/m$^2$ (manufactured by Oji Paper Co., Ltd.) with a size of 13×19 inch, every hundred thousand sheets. It was visually checked whether image failures such as a scratch, a streak and gloss unevenness existed on this image. Then, in the case where the number of fed sheets at the time when the image failure was confirmed was less than six hundred thousand sheets, the number of the fed sheets was recorded at the time when the image failure was confirmed, the durability was determined not to be satisfactory, and the test was finished. In the case where the number of fed sheets at the time when the image failure was confirmed exceeded six hundred thousand sheets, the durability was determined to be satisfactory, and the test was finished.

In the present example, the image failure did not occur even when the number of fed sheets exceeded six hundred thousand sheets, and accordingly the durability was determined to be satisfactory.

Examples 2 to 4

The mixing ratio between spherical alumina and amorphous alumina of the filler was adjusted, and the area proportion A of the first filler having a major axis/minor axis of smaller than 1.5, and the area proportion B of the second filler having a major axis/minor axis of 1.5 or larger were each determined to be a value shown in Table 1. Fixing belts were produced and evaluated in the same manner as in Example 1, except for the above points.

Example 5

The mixing ratio between the spherical alumina and the amorphous alumina of the filler was adjusted, and also silica (trade name: Tospearl, manufactured by Toshiba Silicones Co., Ltd.) of the spherical filler was added.

The area proportion A of the first filler (alumina+silica) having a major axis/minor axis of smaller than 1.5 was set at 0.25, and the area proportion B of the second filler (alumina) having a major axis/minor axis of 1.5 or larger was set at 0.17.

A fixing belt was produced and evaluated in the same manner as in Example 1, except for the above points.

Example 6

Nearly spherical magnesium oxide (trade name: SL-WR, manufactured by Konoshima Chemical Industry Co., Ltd.) and amorphous magnesium oxide (trade name: RF-10C-FC, manufactured by Ube Material Industries, Ltd.) were used as the fillers.

In addition, the area proportion A of the first filler having a major axis/minor axis of smaller than 1.5 was set at 0.20, and the area proportion B of the second filler having a major axis/minor axis of 1.5 or larger was set at 0.20.

A fixing belt was produced and evaluated in the same manner as in Example 1, except for the above points.

Example 7

Nearly spherical zinc oxide (trade name: LPZINC-11; manufactured by Sakai Chemical Industry Co., Ltd.) and amorphous zinc oxide (trade name: Pana-Tetra WZ-05F1, manufactured by Matsushita Amtech Co., Ltd.) were used as the fillers.

In addition, the area proportion A of the first filler having a major axis/minor axis of smaller than 1.5 was set at 0.25, and the area proportion B of the second filler having a major axis/minor axis of 1.5 or larger was set at 0.20.

A fixing belt was produced and evaluated in the same manner as in Example 1, except for the above points.

Comparative Example 1

A fixing belt was produced and evaluated in the same manner as in Example 1, except that the electric field was not applied.

Comparative Example 2

The electric field was not applied; and the mixing ratio between the spherical alumina and the amorphous alumina of the filler was adjusted so that the area proportion A of the first filler having a major axis/minor axis of smaller than 1.5 was set at 0.30, and the area proportion B of the second filler having a major axis/minor axis of 1.5 or larger was set at 0.25.

A fixing belt was produced and evaluated in the same manner as in Example 1, except for the above points.

Comparative Examples 3 to 5

The mixing ratio between the spherical alumina and the amorphous alumina of the filler was adjusted, and the area proportion A of the first filler having a major axis/minor axis of smaller than 1.5, and the area proportion B of the second filler having a major axis/minor axis of 1.5 or larger were each determined to be a value shown in Table 1. Fixing belts were produced and evaluated in the same manner as in Example 1, except for the above points.

The above results are shown in Table 1 and Table 2. Note that the fixing property and the image quality in the evaluation of the fixing belt are described according to the following criteria.

(1) Fixing Property

Rank A: the toner was fixed on the paper at a temperature control set to be lower by 15° C. than the standard temperature control (195° C.).

Rank B: the toner was fixed on the paper at a temperature control set to be lower by 10° C. than the standard temperature control (195° C.).

Rank D: the toner was not fixed on the paper at a temperature control set to be lower by 10° C. than the standard temperature control (195° C.).

(2) Image Quality

Rank A: extremely excellent without gloss unevenness.

Rank B: excellent without gloss unevenness.

Rank C: there was slightly gloss unevenness.

Rank D: there was gloss unevenness.

-: image quality was not evaluated.

TABLE 1

| | Formulation of material, and working | | | | | | | |
|---|---|---|---|---|---|---|---|---|
| | Filler with ratio of major axis/minor axis smaller than 1.5 | | Filler with ratio of major axis/minor axis of 1.5 or larger | | | Ratio of area | Sum of area | |
| | Filler type | Area proportion A | Filler type | Area proportion B | Average orientation angle $\theta_{Ave}$ | proportion A/B of fillers | proportion A + B of fillers | Electric field application |
| Example 1 | $Al_2O_3$ | 0.30 | $Al_2O_3$ | 0.16 | 60 | 1.9 | 0.46 | Present |
| Example 2 | $Al_2O_3$ | 0.30 | $Al_2O_3$ | 0.20 | 61 | 1.5 | 0.50 | Present |
| Example 3 | $Al_2O_3$ | 0.30 | $Al_2O_3$ | 0.15 | 59 | 2.0 | 0.45 | Present |
| Example 4 | $Al_2O_3$ | 0.20 | $Al_2O_3$ | 0.20 | 50 | 1.0 | 0.40 | Present |
| Example 5 | $SiO_2 + Al_2O_3$ | 0.25 | $Al_2O_3$ | 0.17 | 56 | 1.5 | 0.42 | Present |
| Example 6 | MgO | 0.20 | MgO | 0.20 | 65 | 1.0 | 0.40 | Present |
| Example 7 | ZnO | 0.25 | ZnO | 0.20 | 52 | 1.3 | 0.45 | Present |
| Comparative Example 1 | $Al_2O_3$ | 0.30 | $Al_2O_3$ | 0.16 | 38 | 1.9 | 0.46 | Absent |
| Comparative Example 2 | $Al_2O_3$ | 0.30 | $Al_2O_3$ | 0.25 | 35 | 1.2 | 0.55 | Absent |
| Comparative Example 3 | $Al_2O_3$ | 0.15 | $Al_2O_3$ | 0.15 | 55 | 1.0 | 0.30 | Present |
| Comparative Example 4 | $Al_2O_3$ | 0.20 | $Al_2O_3$ | 0.25 | 57 | 0.8 | 0.45 | Present |
| Comparative Example 5 | $Al_2O_3$ | 0.30 | $Al_2O_3$ | 0.10 | 43 | 3.0 | 0.40 | Present |

TABLE 2

| | Physical properties of elastic layer | | | Fixing belt | | |
|---|---|---|---|---|---|---|
| | Coefficient of Thermal conductivity in thickness direction (W/m · K) | Tensile modulus of elasticity (MPa) | Pressure resistance durability | Fixing property | Image quality | Paper passing durability |
| Example 1 | 1.40 | 0.63 | 10 hours (Good) | B (−10 C.) | A | 600000 sheets endurance OK |
| Example 2 | 1.60 | 0.90 | 8 hours | A (−15 C.) | C | 600000 sheets endurance OK |
| Example 3 | 1.42 | 0.60 | 10 hours (Good) | B (−10 C.) | B | 600000 sheets endurance OK |
| Example 4 | 1.30 | 0.58 | 10 hours (Good) | B (−10 C.) | A | 600000 sheets endurance OK |
| Example 5 | 1.34 | 0.61 | 10 hours (Good) | B (−10 C.) | A | 600000 sheets endurance OK |
| Example 6 | 1.60 | 0.73 | 10 hours (Good) | A (−15 C.) | A | 600000 sheets endurance OK |
| Example 7 | 1.31 | 0.68 | 10 hours (Good) | B (−10 C.) | A | 600000 sheets endurance OK |
| Comparative Example 1 | 0.95 | 0.56 | 10 hours (Good) | D | — | 600000 sheets endurance OK |

TABLE 2-continued

| | Physical properties of elastic layer | | | Fixing belt | | |
|---|---|---|---|---|---|---|
| | Coefficient of Thermal conductivity in thickness direction (W/m · K) | Tensile modulus of elasticity (MPa) | Pressure resistance durability | Fixing property | Image quality | Paper passing durability |
| Comparative Example 2 | 1.30 | 1.36 | 2 hours | B (−10 C.) | D | 100000 sheets endurance NG |
| Comparative Example 3 | 0.93 | 0.40 | 10 hours (Good) | D | — | 600000 sheets endurance OK |
| Comparative Example 4 | 1.46 | 0.58 | 4 hours | B (−10 C.) | A | 400000 sheets endurance NG |
| Comparative Example 5 | 0.80 | 0.53 | 3 hours | D | — | 200000 sheets endurance NG |

The following facts are understood from the results shown in Table 1 and Table 2.

In Comparative Example 1 in which the electric field was not applied, the second fillers having the major axes/minor axes being 1.5 or larger are not oriented (where average orientation angle $\theta_{Ave}$ was smaller than 50°).

On the other hand, in Example 1 in which the electric field was applied, the second fillers having a major axis/minor axis of 1.5 or larger were oriented in the thickness direction (where average orientation angle $\theta_{Ave}$ was 50° or larger and 90° or smaller), and the coefficient of thermal conductivity in the thickness direction was high.

In addition, Examples 1 to 7 shall be compared to Comparative Examples 3 to 5, and then when $1.0 \leq (A/B) \leq 2.0$ and $0.40 \leq (A+B) \leq 0.50$, the second fillers having a major axis/minor axis of 1.5 or larger are oriented in the thickness direction. In addition, the coefficients of thermal conductivity in the thickness direction are also high. As a result, it is understood that Examples 1 to 8 show an improved fixing properties.

Specifically, in all Examples, the coefficients of thermal conductivity in the thickness direction are 1.30 W/(m·K) or higher, and the fixing properties are satisfactory; and in particular, Examples in which the coefficients of thermal conductivity in the thickness direction are 1.60 W/(m·K) or higher show a further satisfactory fixing properties.

On the other hand, in Comparative Examples 1, 3 and 5 in which the coefficients of thermal conductivity in the thickness direction were lower than 1.30 W/(m·K), the fixing properties were low.

In addition, each of the elastic layers of the fixing members prepared in Examples 1 to 8 had the tensile moduli of elasticity are as low as 0.20 MPa or higher and 1.20 MPa or lower (where 1.20 MPa corresponds to approximately 50° in Asker C hardness (JIS K7312)), and it is understood that the hardness is low.

It is understood that as a result, the fixing members of Examples 1 to 8 can well follow the irregularities of the fibers of the paper, which is the recording material, in the fixing nip, resists causing softening and melting unevenness of the toner, and provides a high-quality image.

On the other hand, in Comparative Example 2 in which the tensile modulus of elasticity exceeded 1.20 MPa, a high-quality image was not obtained.

Furthermore, also in the evaluation of the pressure resistance durability at high temperature, in all Examples, the durability lasts for 5 hours or longer; and in most Examples, the fracture or the plastic deformation does not occur even after 10 hours or longer, and the durability is satisfactory. As a result, the fixing member can exhibit high durability even in a paper passing durability test in which repeated stress is applied in a high temperature state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-096549, filed May 23, 2019, which is hereby incorporated by reference herein in its entirety.

What is claimed is:

1. An electrophotographic fixing member comprising:

a substrate; and an elastic layer on an outer circumference of the substrate, the elastic layer containing fillers each of which contains an inorganic oxide, wherein (1) when a binarized image on a first cross-section in a thickness-circumferential direction of the elastic layer, and a binarized image on a second cross-section in a thickness-axial direction of the elastic layer are obtained, and when a shape of each of the fillers observed in the respective binarized images is approximated to an ellipse, among the fillers, an area proportion of a first fillers each having a major axis/minor axis of smaller than 1.5 is represented by A, and an area proportion of a second fillers each having a major axis/minor axis of 1.5 or larger is represented by B, A and B satisfy the following relation $1.0 \leq (A/B) \leq 2.0$ and $0.40 \leq (A+B) \leq 0.50$ are satisfied; and (2) an average orientation angle of the second fillers with respect to a thickness direction of the elastic layer is defined as $\theta_{Ave}$, $\theta_{Ave}$ is 50° or more and 90° or less.

2. The electrophotographic fixing member according to claim 1, wherein a coefficient of thermal conductivity of the elastic layer in the thickness direction is 1.30 W/(m·K) or higher and lower than 2.00 W/(m·K).

3. The electrophotographic fixing member according to claim 1, wherein the fillers each contains at least one member selected from the group consisting of alumina, zinc oxide, magnesium oxide and silicon oxide.

4. The electrophotographic fixing member according to claim 1, wherein the elastic layer comprises silicone rubber as a binder.

5. The electrophotographic fixing member according to claim 1, wherein the electrophotographic fixing member is a fixing belt having an endless shape.

6. The fixing member according to claim 5, wherein the fixing belt is heated by non-radiant heating to fix an unfixed toner image on a recording material in a fixing apparatus.

7. A fixing apparatus for heating an unfixed toner image on a recording medium with an electrophotographic fixing member and for fixing the unfixed toner image onto the recording medium, wherein the electrophotographic fixing member comprises a substrate, and an elastic layer on an outer circumference of the substrate, the elastic layer containing a filler containing an inorganic oxide, wherein (1) when a binarized image on a first cross-section in a thickness-circumferential direction of the elastic layer, and a binarized image on a second cross-section in a thickness-axial direction of the elastic layer are obtained, and when a shape of each of the fillers observed in the respective binarized images is approximated to an ellipse, among the fillers, an area proportion of a first fillers having a major axis/minor axis of smaller than 1.5 is represented by A, and an area proportion of a second fillers having a major axis/minor axis of 1.5 or larger is represented by B, A and B satisfy the following relation $1.0 \leq (A/B) \leq 2.0$ and $0.40 \leq (A+B) \leq 0.50$ are satisfied; and (2) an average orientation angle of the second fillers with respect to a thickness direction of the elastic layer is defined as $\theta_{Ave}$, $\theta_{Ave}$ is, 50° or more and 90° or less.

8. The fixing apparatus according to claim 7, wherein the electrophotographic fixing member is a fixing belt having an endless shape.

9. The fixing apparatus according to claim 7, wherein the fixing belt forms a fixing nip together with a pressing member that is arranged so as to be opposite to the fixing belt, and a heater for heating the fixing belt by non-radiant heating is in contact with an inner circumferential surface of the fixing belt.

10. An image forming apparatus comprising:

a photosensitive member;

a charging apparatus for charging the photosensitive member;

an exposure apparatus for forming an electrostatic latent image by exposing the charged photosensitive member to light, a developing apparatus for developing the electrostatic latent image formed on the photosensitive member with a toner to form a toner image;

a transfer apparatus for transferring the toner image formed on the photosensitive member to a recording medium; and a fixing apparatus, wherein the fixing apparatus heats an unfixed toner image on the recording medium with an electrophotographic fixing member and fixes the unfixed toner image onto the recording medium, wherein the electrophotographic fixing member comprises a substrate, and an elastic layer on an outer circumference of the substrate, and the elastic layer containing a filler containing an inorganic oxide, wherein (1) when a binarized image on a first cross-section in a thickness-circumferential direction of the elastic layer, and a binarized image on a second cross-section in a thickness-axial direction of the elastic layer are obtained and when a shape of each of the fillers observed in the respective binarized images is approximated to an ellipse, among the fillers, an area proportion of a first fillers each having a major axis/minor axis of smaller than 1.5 is represented by A, and an area proportion of a second fillers each having a major axis/minor axis of 1.5 or larger is represented by B, A and B satisfy the following relation $1.0 \leq (A/B) \leq 2.0$ and $0.40 \leq (A+B) \leq 0.50$ are satisfied; and (2) an average orientation angle of the second fillers with respect to a thickness direction of the elastic layer is defined as $\theta_{Ave}$, $\theta_{Ave}$ is 50° or more and 90° or less.

* * * * *